US007401551B2

(12) United States Patent
Nakamura et al.

(10) Patent No.: US 7,401,551 B2
(45) Date of Patent: Jul. 22, 2008

(54) STENCIL PRINTING MACHINE

(75) Inventors: Akira Nakamura, Ibaraki-ken (JP); Taku Naitou, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 330 days.

(21) Appl. No.: 11/063,604

(22) Filed: Feb. 24, 2005

(65) Prior Publication Data

US 2005/0183591 A1 Aug. 25, 2005

(30) Foreign Application Priority Data

Feb. 25, 2004 (JP) ..... P2004-049505
Feb. 25, 2004 (JP) ..... P2004-049968
Mar. 17, 2004 (JP) ..... P2004-076134

(51) Int. Cl.
*B41F 15/38* (2006.01)
*B41L 13/04* (2006.01)

(52) U.S. Cl. ..... 101/118; 101/116

(58) Field of Classification Search ..... 101/118
See application file for complete search history.

(56) References Cited

U.S. PATENT DOCUMENTS 5,586,497 A * 12/1996 Shimada ..... 101/128.4
6,067,902 A * 5/2000 Takahashi ..... 101/118
6,250,078 B1 * 6/2001 Amendola et al. ..... 60/509
6,263,791 B1 7/2001 Sato
2002/0112621 A1 * 8/2002 Kinoshita et al. ..... 101/118

FOREIGN PATENT DOCUMENTS

| | | |
|---|---|---|
| DE | 196 44 945 | 4/1998 |
| JP | 62-142677 | 6/1987 |
| JP | 02-043145 | 2/1990 |
| JP | 2000-103155 | 4/2000 |
| JP | 2003-136823 | 5/2003 |

* cited by examiner

*Primary Examiner*—Daniel J Colilla
(74) *Attorney, Agent, or Firm*—Nath Law Group; Jerald L. Meyer; Derek Richmond

(57) ABSTRACT

A stencil printing machine includes a drum on which a stencil sheet is mounted, and a pressure roller which presses a print sheet fed between the drum and the pressure roller and rotates together with the drum. The print sheet is fed from an upstream side of the pressure roller in a conveying direction, an image is transferred from the stencil sheet onto the fed print sheet in a process where the print sheet passes between the drum and the pressure roller, and the print sheet on which the image is transferred is discharged to a downstream side of the pressure roller in the conveying direction. A suction port forming plate taking a surface thereof as a sheet conveying surface is provided at a position close to a downstream peripheral surface of the pressure roller in the conveying direction, a suction port surrounded by the suction port forming plate and the peripheral surface of the pressure roller is provided, and a suction fan which sucks the air on an outer side of the sheet conveying surface from the suction port is provided.

4 Claims, 20 Drawing Sheets

STENCIL PRINTING MACHINE

BACKGROUND OF THE INVENTION

1. Field of the Invention

The present invention relates to a stencil printing machine which performs an image transfer by conveying a print sheet while applying printing pressure to a rotating drum, and particularly, relates to a technology for peeling off the print sheet from the drum and a technology for feeding the print sheet between the drum and a pressure roller.

2. Description of the Related Art

This type of stencil printing machine includes a scanner unit which reads image data of an original to be printed, a stencil making unit which perforates a stencil sheet based on the image data read by the scanner unit, a printing unit which attaches the stencil sheet prepared by the stencil making unit onto the drum and transfers an image on the print sheet by conveying the print sheet while applying printing pressure to the rotating drum, a paper feed unit which feeds the print sheet to the printing unit, a paper discharge unit which discharges the print sheet on which the image is printed by the printing unit, and a stencil disposal unit which removes the stencil sheet attached onto the drum. Then, means which uses an instantaneous separation blow for surely peeling off the print sheet which is conveyed together with the rotation of the drum and has passed through an image transfer position is disclosed in FIG. 1 and FIG. 2 (Japanese Patent Laid-Open Publication No. 2003-136823).

The means is described by use of FIG. 1. A drum 100 has a stencil sheet 101 attached onto an outer peripheral surface 100*a* thereof, and rotates in a direction of an arrow A by driving force of a drum motor (not shown). A pressure roller 102 is provided at a position below the drum 100 so as to be freely movable, and presses a fed print sheet 103 to the drum 100 to apply the printing pressure thereto. A separation claw 104 is placed at a position which is downstream of the image transfer position of the drum 100 and near the outer peripheral surface 100*a* of the drum 100, and on a tip of the separation claw 104, a blast nozzle (not shown) is provided. The blast nozzle is connected to a separation pump 106 through a blast pipe 105, and the separation pump 106 is adapted to generate the instantaneous blow in synchronization with the rotation of the drum 100 by using the drum motor as a drive source.

In the configuration described above, the print sheet 103 is conveyed in a sheet conveying direction 107 while the printing pressure is being applied to the outer peripheral surface 100*a* of the rotating drum 100, and the image is transferred from the stencil sheet 101 to the print sheet 103 in this conveying process. Then, when a tip of the print sheet 103 in the conveying direction comes to a rotation position where the image transfer is completed, the separation blow is blown instantaneously from the tip of the separation claw 104 to between the tip of the print sheet 103 in the conveying direction and the outer peripheral surface 100*a* of the drum 100. By the separation blow, the tip of the print sheet 103 in the conveying direction is peeled off from drum 100. The tip side of the print sheet 103 in the conveying direction, which has been peeled off from the drum 100, is guided to a lower side of the separation claw 104 as shown in FIG. 2, and the print sheet 103 guided below the separation claw 104 is sequentially peeled off from the drum 100. The print sheet 103 peeled off from the drum 100 is conveyed to a predetermined discharge passage.

Specifically, because the print sheet 103 immediately after the image is printed thereon adheres to the drum 100 owing to viscosity of ink, the strong separation blow is blown to between the tip of the print sheet 103 in the conveying direction and the outer peripheral surface 100*a* of the drum 100 to separate the tip side of the print sheet 103 from the drum 100 forcibly. Then, the tip of the print sheet 103 in the conveying direction, which is separated from the drum 100, is guided by the separation claw 104, and thus the print sheet 103 is surely peeled off from the drum 100.

However, in the conventional stencil printing machine described above, there has been a possibility that the print sheet 103 is brought into contact with the separation claw 104, and there has been a problem that the contact of a printing surface of the print sheet 103 with the separation claw 104 causes stain of the printing surface. Moreover, the separation claw 104 is placed near the drum 100, and accordingly, there has been a possibility that the separation claw 104 pierces the drum 100 when a trouble occurs. Furthermore, the blasting from the separation pump 106 is performed only at timing of peeling off the tip side of the print sheet 103 in the conveying direction from the drum 100, and accordingly, there has been a possibility that timing when the respective spots downstream of the tip side of the print sheet 103 in the conveying direction are peeled off from the drum 100 is not stabilized, leading to generation of unevenness of the image owing to unevenness of the peeling-off timing.

Moreover, as another configuration of the paper feed unit of the conventional stencil printing machine, there is one shown in FIG. 3 (Japanese Patent Laid-Open Publication No. H2-43145 (published in 1990)).

The paper feed unit is briefly described by use of FIG. 3. A paper feed unit 200 includes a paper feed tray 202 on which a large number of print sheets 201 are loaded, a primary paper feed roller 203 placed at an upper position of the paper feed tray 202, a pair of secondary paper feed rollers 204*a* and 204*b* placed on the downstream side of the primary paper feed roller 203 in the conveying direction, and a lower guide member 205 and an upper guide member 206, which guide a lower side and upper side of each conveyed print sheet 201. The lower guide member 205 is placed from the paper feed tray 202 through the lower secondary paper feed roller 204*a* toward the vicinity of a pressure roller 207 and a drum 208. Moreover, the upper guide member 206 is placed only between the primary paper feed roller 203 and the upper secondary paper feed roller 204*b* and only in the periphery of the downstream side of the upper secondary paper feed roller 204*b* in the conveying direction.

Next, a paper feed operation is described. When the primary paper feed roller 203 is rotated, the uppermost print sheet 201 pressed onto the primary paper feed roller 203 is conveyed, the conveyed print sheet 201 is guided by the lower guide member 205 and the upper guide member 206, a tip of the print sheet 201 abuts on the pair of secondary paper feed rollers 204*a* and 204*b* at a contact point thereof, and the print sheet 201 is conveyed to a position where a rear end side of the print sheet 201 bends.

Next, when the pair of secondary paper feed rollers 204*a* and 204*b* are rotationally driven at predetermined timing, the bent print sheet 201 enters between the pair of secondary paper feed rollers 204*a* and 204*b* by return force thereof to return straight, and the print sheet 201 is fed between the drum 208 and the pressure roller 207 in synchronization with the rotations of the pair of secondary paper feed rollers 204*a* and 204*b*.

In this conventional example, stable paper feed is performed by regulating the upper and lower surfaces of the print sheet 201 by the lower guide member 205 and the upper guide member 206.

However, it is necessary to set a gap between the lower guide member 205 and the upper guide member 206 at a dimension sufficiently larger than thickness of the print sheet 201 such that the gap does not resist the conveyance of the print sheet 201. Accordingly, the tip side of the print sheet 201 can freely bend within a range of the gap dimension. Moreover, though the lower guide member 205 can be extended toward the vicinity of the pressure roller 207, the upper guide member cannot be extended toward the vicinity of a position where the print sheet 201 enters between the drum 208 and the pressure roller 207 because of the presence of the drum 208 with a large diameter. Accordingly, the tip side of the print sheet 201 can freely bend to the drum 208 side. Owing to these facts, there has been a possibility that the print sheet 201 is fed between the drum 208 and the pressure roller 207 in a state where the tip side thereof is bending. When the print sheet 201 is fed in the state as described above, there has been a possibility that a wrinkle and a crease occur in the print sheet 201. Moreover, when the print sheet 201 largely bends to the drum 208 side by rotational suction force of the drum 208 and the like, there has been a possibility that the print sheet 201 contacts the drum 208 before being fed between the drum 208 and the pressure roller 207, thereby generating an image ghost on the print sheet 201.

SUMMARY OF THE INVENTION

It is an object of the present invention to provide a stencil printing machine capable of preventing the stain of the printing surface and the piercing of the separation claw in the drum, which are caused by use of the separation claw, and capable of preventing the unevenness of the image owing to the unevenness of the peeling-off timing of the print sheet.

It is another object of the present invention to provide a stencil printing machine which eliminates the generation of the wrinkle, the crease and the like on the print sheet owing to the unstable paper feed and eliminates the generation of the image ghost owing to the contact of the print sheet with the drum.

In order to achieve the foregoing objects, a first aspect of the present invention is a stencil printing machine, including: a rotationally driven drum, in which a stencil sheet is mounted on an outer peripheral surface; a pressure roller which presses a print sheet fed to between the drum and the pressure roller and rotates together with the drum, in which the print sheet is fed from an upstream side of the pressure roller in a conveying direction to between the drum and the pressure roller, an image is transferred from the stencil sheet onto the fed print sheet in a process where the print sheet passes between the drum and the pressure roller, and the print sheet on which the image is transferred is discharged to a downstream side of the pressure roller in the conveying direction; a suction port forming plate which is provided at a position close to a downstream peripheral surface of the pressure roller in the conveying direction and has a sheet conveying surface, in which a suction port is formed between the peripheral surface of the pressure roller and the suction port forming plate; and a suction fan which sucks air on an outer side of the sheet conveying surface from the suction port.

According to the present invention, the suction port is placed at a position which is immediately after the printing pressure from the drum and the pressure roller is released and is sufficiently close to the drum, and the print sheet is sucked with extremely strong suction force. Accordingly, the print sheet can be peeled off from the drum only by a suction wind. Hence, the stain of the printing surface and the piercing of the separation claw in the drum, which are caused by use of the separation claw concerned, can be prevented. Moreover, if the print sheet is sucked from the suction port throughout the passing process thereof from the tip to the rear end in the conveying direction, then every spot of the print sheet from the tip to the rear end in the conveying direction is always peeled off from the drum at a position where the print sheet comes out from the pressure roller. Hence, the unevenness of the image owing to the unevenness of the peeling-off timing of the print sheet can be prevented.

In a preferred embodiment of the present invention, the pressure roller is freely movable between a press position of pressing the drum and a standby position of being spaced from the drum, and the suction port forming plate may be provided to be freely movable together with the pressure roller.

With the configuration described above, only at the time of performing the printing operations while setting the pressure roller at the press position to the drum, the suction port forming plate is placed at the position close to the drum, and at the other time, is shifted to the position of being spaced from the drum together with the pressure roller. Therefore, the suction port forming plate does not inhibit work of maintenance and exchange of the drum.

Moreover, effective width of the suction port may be set at width larger than the maximum width of the print sheet feedable.

With the configuration described above, the suction force can be applied to the entire width of the print sheet, and therefore, the print sheet can be peeled off from the drum surely and stably.

Moreover, the suction port may be divided by a plurality of sheet suction preventing protrusions placed along the sheet conveying direction.

With the configuration described above, the print sheet is not sucked to the suction port by the suction force.

Furthermore, the suction port forming plate is formed as a part of a suction box which generates a suction wind from the suction port in a manner that pressure in the suction box is reduced by a drive of the suction fan, and the pressure roller may be assembled to the suction box to construct a suction unit.

With the configuration described above, if the suction unit is detached from a body of the machine and attached thereonto, then the suction box and the pressure roller can be detached therefrom and attached thereonto. Hence, maintenance and exchange of the suction box and the pressure roller are easy.

Furthermore, the drum may also be assembled to the suction box so as to be freely movable.

With the configuration described above, maintenance and exchange of the drum are also easy.

Moreover, a second aspect of the present invention is a stencil printing machine, including: a rotationally driven drum, in which a stencil sheet is mounted on an outer peripheral surface; a pressure roller which presses a print sheet fed to between the drum and the pressure roller and rotates together with the drum, in which the print sheet is fed from an upstream side of the pressure roller in a conveying direction to between the drum and the pressure roller, an image is transferred from the stencil sheet onto the fed print sheet in a process where the print sheet passes between the drum and the pressure roller, and the print sheet on which the image is transferred is discharged to a downstream side of the pressure roller in the conveying direction; a suction nozzle provided at a position adjacent to the pressure roller on a downstream side in the conveying direction to be freely movable between a suction position close to the outer peripheral surface of the drum and a conveying track position spaced from the outer peripheral surface of the drum; a suction fan which sucks air on an outer side which is the drum side from the suction nozzle; and an urging device which urges the suction nozzle to the suction position side and has urging force weaker than suction force applied to the suction nozzle in a state where the suction nozzle is closed by the print sheet.

With the configuration described above, the suction nozzle is placed at a position which is immediately after the printing pressure from the drum and the pressure roller is released and is sufficiently close to the drum. Accordingly, the print sheet is sucked by the suction nozzle with extremely strong suction force. When the print sheet gradually closes the suction nozzle, and the suction force applied to the suction nozzle exceeds the urging force of the urging device, the suction nozzle shifts to the conveying track position in a state of sucking the tip of the print sheet in the conveying direction, and the tip of the print sheet in the conveying direction is peeled off from the drum, and is changed onto a track having a large peeling angle with respect the drum. Moreover, the suction force of the suction nozzle works efficiently to peel off the print sheet conveyed on the conveying track having the large peeling angle with respect to the drum. Accordingly, a stable peeling track is obtained. Hence, the stain of the printing surface and the piercing of the separation claw in the drum, which are caused by use of the separation claw concerned, can be prevented. Moreover, every spot of the print sheet from the tip to the rear end in the conveying direction is surely peeled off from the drum at the position where the print sheet comes out from the pressure roller. Hence, the unevenness of the image owing to the unevenness of the peeling-off timing of the print sheet can be prevented.

Moreover, in a preferred embodiment of the present invention, the pressure roller is freely movable between a press position of pressing the drum and a standby position of being spaced from the drum, and the suction nozzle may shift to the suction position by the urging force of the urging device when the pressure roller is located at the press position, and may shift to the conveying track position against the urging force of the urging device when the pressure roller is located at the standby position.

With the configuration described above, only at the time of performing the printing operations while setting the pressure roller at the press position to the drum, the suction nozzle is placed at the position close to the drum, and at the other time, is shifted to the position of being spaced from the drum together with the pressure roller. Therefore, the suction nozzle does not inhibit work of maintenance and exchange of the drum.

Moreover, effective width of the suction nozzle may be set at width larger than the maximum width of the print sheet feedable.

With the configuration described above, the suction force can be applied to the entire width of the print sheet, and therefore, the print sheet can be peeled off from the drum surely and stably.

Moreover, suction ports of the suction nozzle are placed by being divided by a plurality of sheet suction preventing protrusions placed along a sheet conveying direction.

With the configuration described above, the print sheet is not sucked to the suction ports of the suction nozzle by the suction force.

Furthermore, the suction nozzle is placed by being divided in a direction perpendicular to a sheet feeding direction, and the urging device which urges each suction nozzle divided to the conveying track position side may be provided therefor.

With the configuration described above, when the print sheet passes through the suction nozzles, only the suction nozzles corresponding to width of the print sheet shift from the suction position to the conveying track position, and the other suction nozzles remain at the suction position close to the drum. Accordingly, unnecessary suction of the air can be restricted, and thus lowering of the suction force can be restricted to the minimum, and a stable peeling track can be maintained.

Moreover, the suction fan may be configured to perform both of suction from the suction nozzle and suction for a conveying passage.

With the configuration described above, the suction from the suction nozzle and the suction from the conveying passage are performed by the same suction fan, and accordingly, reduction, simplification of a structure and the like of the suction fan can be achieved.

Moreover, a third aspect of the present invention is a stencil printing machine, including: a rotationally driven drum, in which a stencil sheet is mounted on an outer peripheral surface; a pressure roller which presses a print sheet fed to between the drum and the pressure roller and rotates together with the drum, in which an image is transferred from the stencil sheet onto the fed print sheet in a process where the print sheet passes between the drum and the pressure roller, and the print sheet on which the image is transferred is discharged to a downstream side of the pressure roller in a conveying direction; a paper feed unit which feeds the print sheet from an upstream side of the pressure roller in the conveying direction to between the drum and the pressure roller; a feed-side sheet conveying surface which conveys the print sheet to the paper feed unit; a feed-side suction port provided on the feed-side sheet conveying surface; and a suction fan which sucks air on an outer side of the feed-side sheet conveying surface from the feed-side suction port.

With the configuration described above, the tip of the print sheet is conveyed along the feed-side sheet conveying surface by suction force of the feed-side suction port. Accordingly, stable paper feed can be performed without bending the tip of the print sheet. Hence, a wrinkle and a crease do not occur on the print sheet owing to unstable paper feed, or an image ghost does not occur owing to a contact of the print sheet with the drum.

In a preferred embodiment of the present invention, the feed-side suction port may be formed with an upstream peripheral surface of the pressure roller in the sheet conveying direction taken as a hole surface.

With the configuration described above, the print sheet can be sucked by the feed-side suction port at the position immediately before the print sheet concerned enters between the drum and the pressure roller. Accordingly, the print sheet can be surely prevented from entering between the drum and the pressure roller in a state where the tip of the print sheet is bending. Hence, the occurrence of the wrinkle and the crease on the print sheet and the occurrence of the image ghost owing to the contact of the print sheet with the drum can be prevented effectively.

Moreover, a discharge-side sheet conveying surface which conveys the print sheet may be provided on the downstream side of the pressure roller in the conveying direction, a discharge-side suction port may be provided on the discharge-side sheet conveying surface, and a suction fan which sucks air on an outer side of the discharge-side sheet conveying surface from the discharge-side suction port may be provided.

With the configuration described above, the print sheet can be peeled off from the drum by suction force of the discharge-side suction port, and accordingly, the print sheet can be peeled off without using the separation claw or the like.

Moreover, the discharge-side suction port may be formed with a downstream peripheral surface of the pressure roller in the conveying direction taken as a hole surface.

With the configuration described above, the print sheet can be sucked to the discharge-side suction port at a position which is immediately after the printing pressure from the drum and the pressure roller is released and is sufficiently close to the drum. Accordingly, the print sheet can be sucked with strong suction force. Hence, the print sheet can be surely peeled off from the drum.

Furthermore, the stencil printing machine is characterized in that the feed-side suction port and the discharge-side suction port are formed in the same suction box, and are configured to suck the air on the outer sides of the sheet conveying surfaces by a single suction fan which reduces pressure in the suction box.

With the configuration described above, the tip of the print sheet passes above the discharge-side suction pot in a state where the feed-side suction port is closed by the print sheet. Therefore, the print sheet is sucked by the discharge-side suction port with strong suction force. Hence, by the single suction fan, the print sheet can be surely peeled off from the drum, as well as the print sheet is sucked on the feed side.

Moreover, the pressure roller may be assembled to the suction box to construct a suction unit.

With the configuration described above, when the suction unit is detached from the body of the machine and attached thereonto, the suction box and the pressure roller can be detached therefrom and attached thereonto. Hence, maintenance and exchange of the suction box and the pressure roller are easy.

DETAILED DESCRIPTION OF THE PREFERRED EMBODIMENTS

A first embodiment of the present invention is described below based on the drawings.

Figure 1:
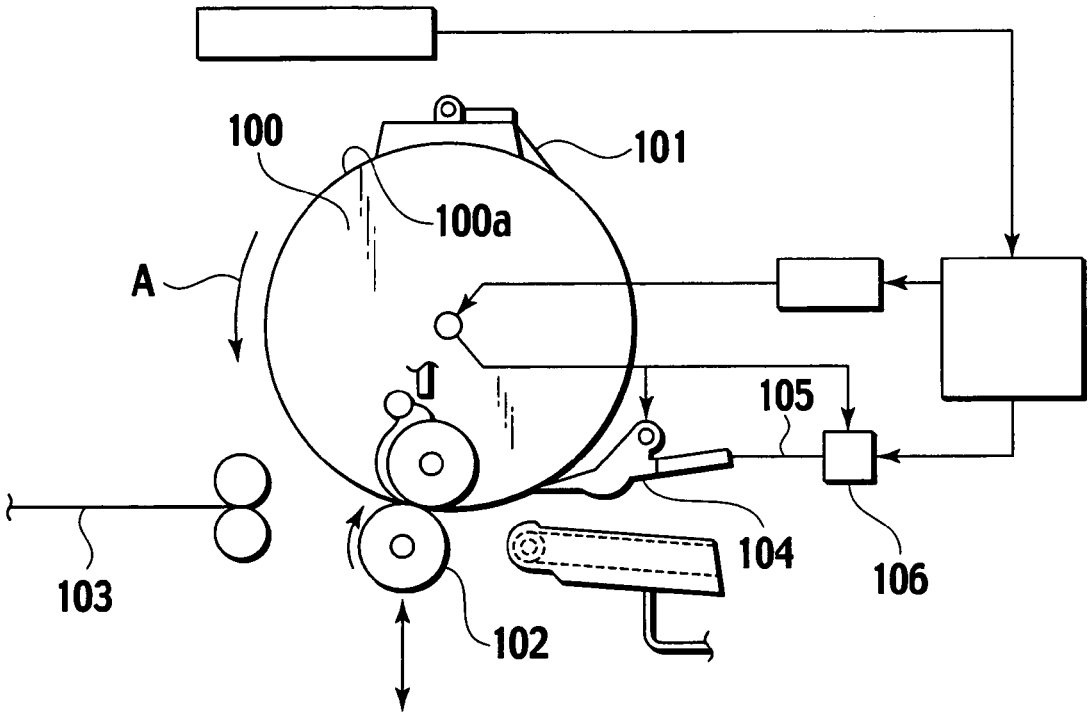
FIG.1 PRIOR ART
FIG. 1 shows a conventional example, and is a configuration view of principal portions of a stencil printing machine.
Figure 2:
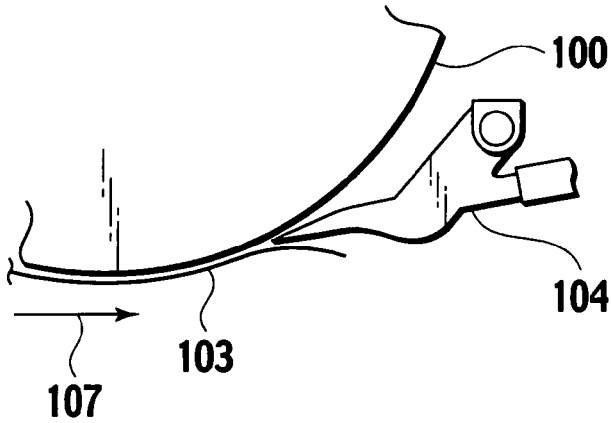
FIG.2 PRIOR ART
FIG. 2 is a view showing a peeling-off operation by a separation claw of the conventional example.
Figure 3:
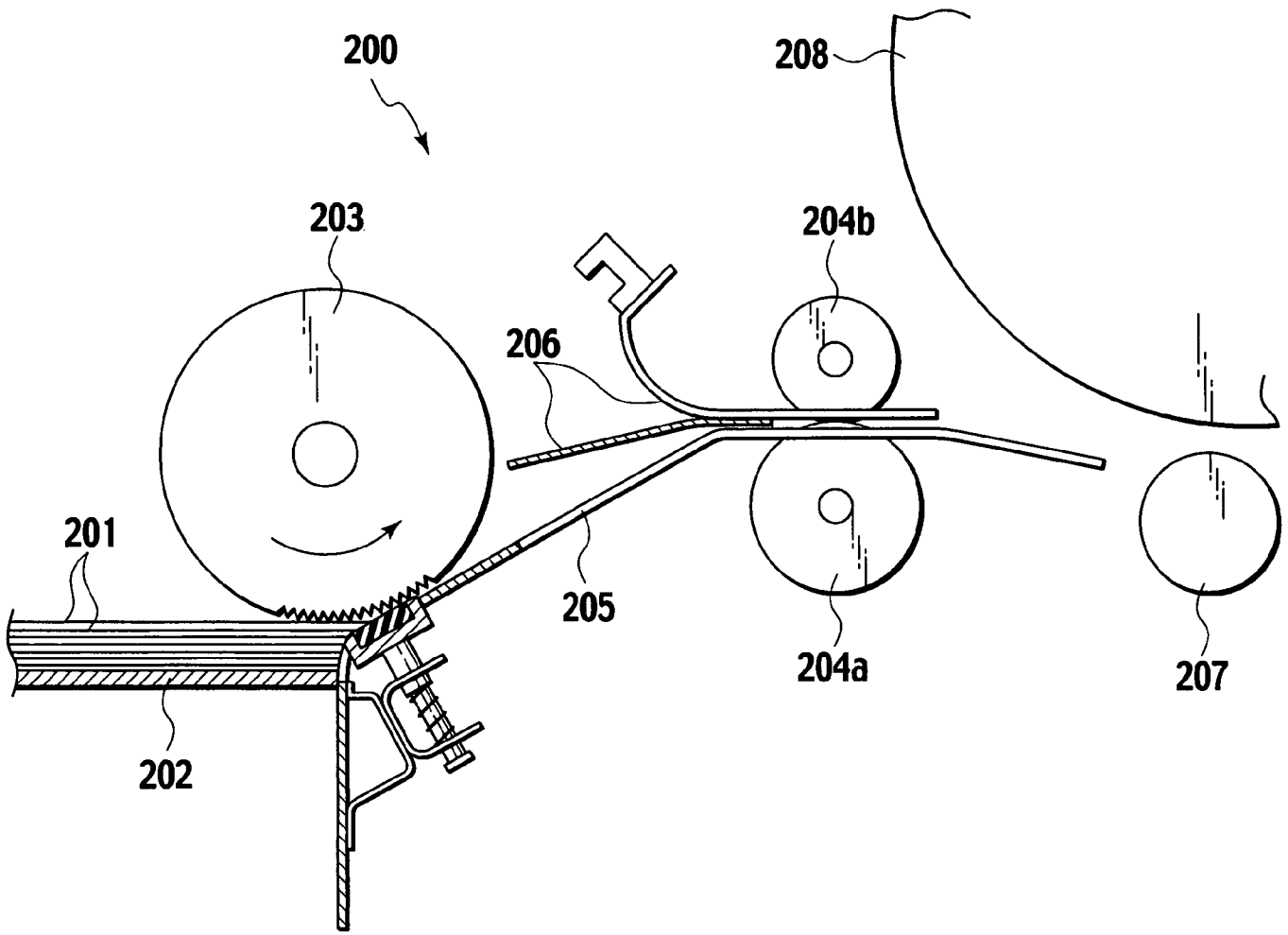
FIG.3 PRIOR ART
FIG. 3 is a side view showing a configuration of a paper feed unit of a conventional example.
Figure 4:
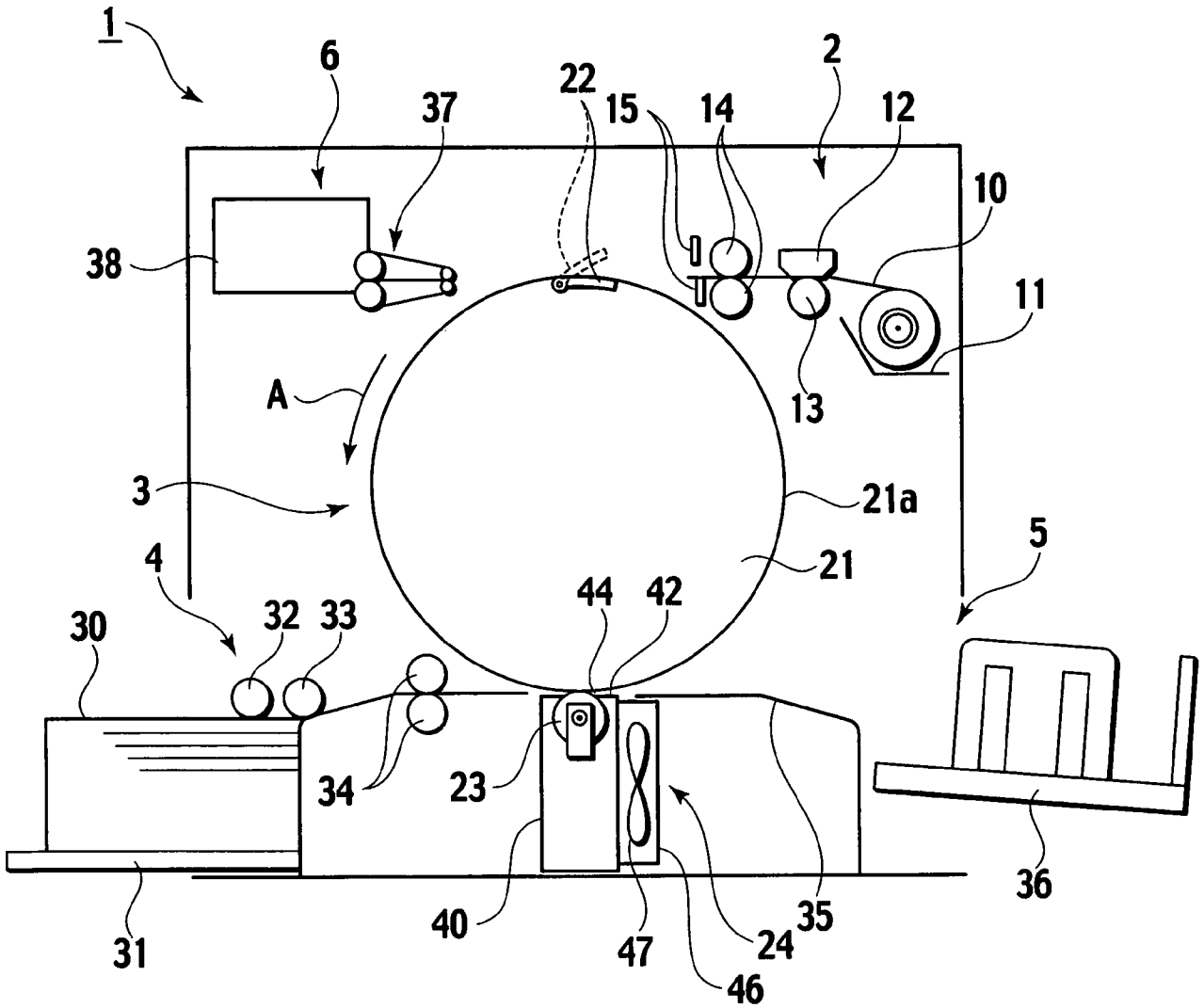
FIG. 4 shows a first embodiment of the present invention, and is a schematic configuration view of a stencil printing machine.
Figure 5:
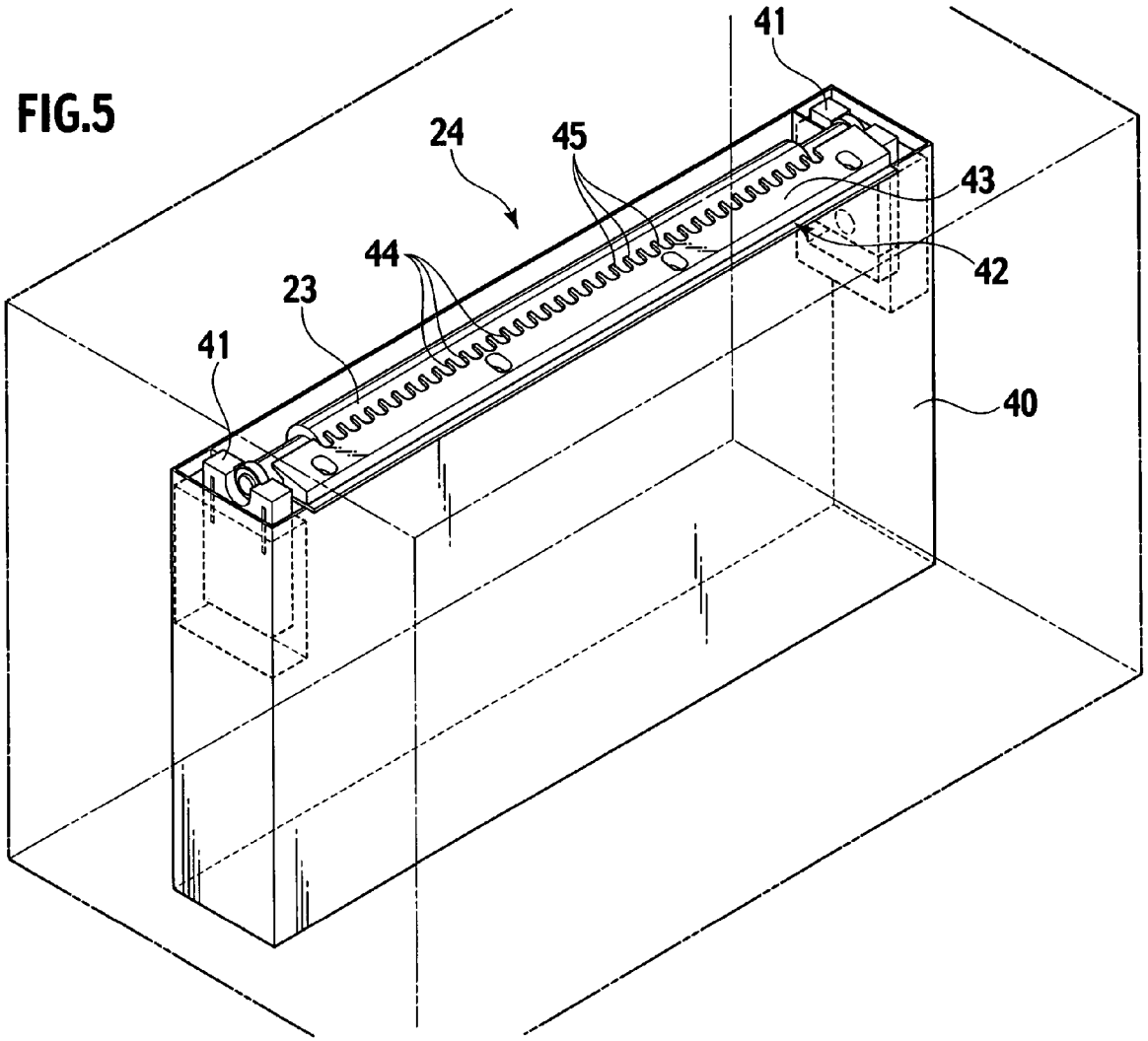
FIG. 5 shows the first embodiment of the present invention, and is a perspective view of a suction unit.
Figure 6:
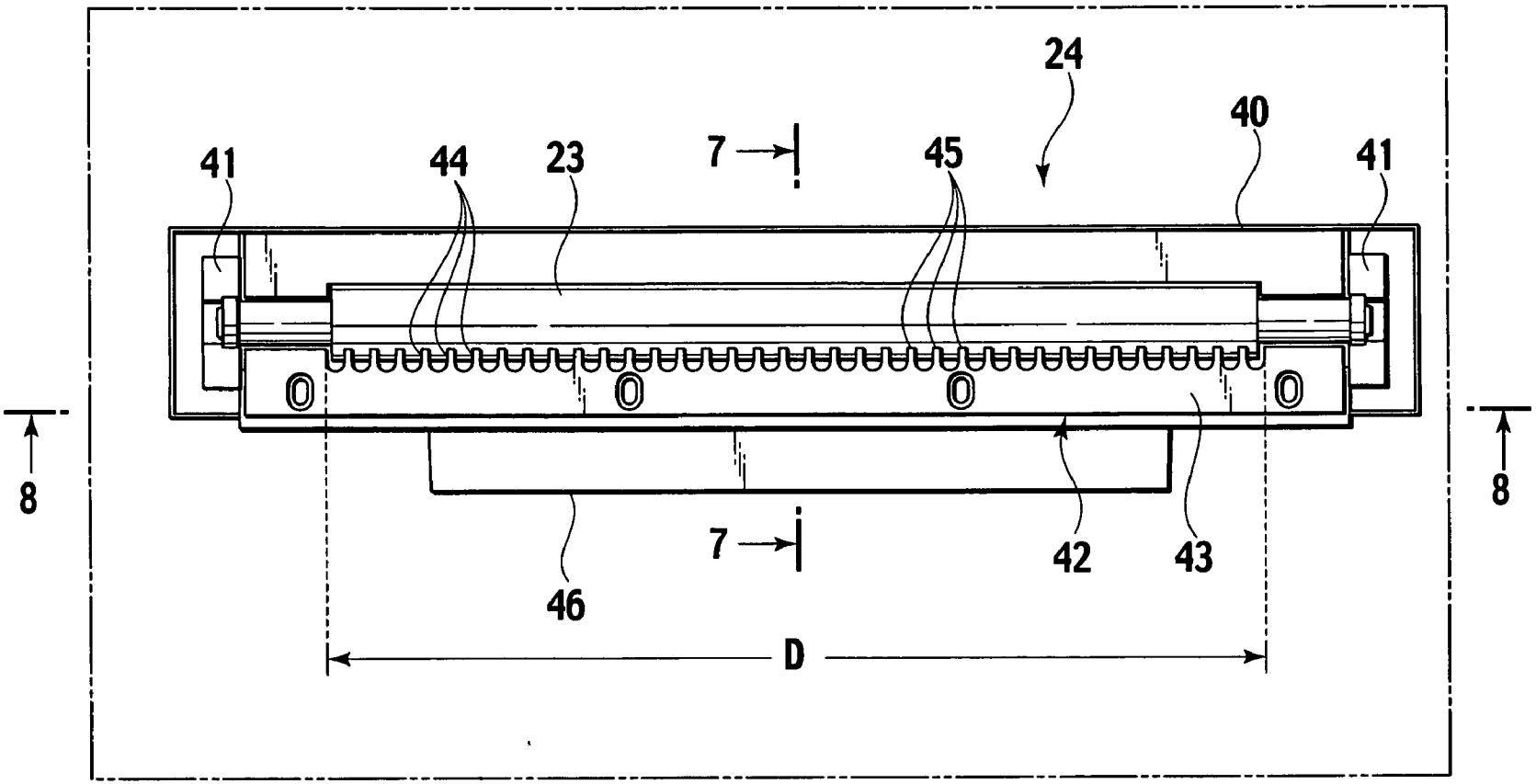
FIG. 6 shows the first embodiment of the present invention, and is a plan view of the suction unit.
Figure 7:
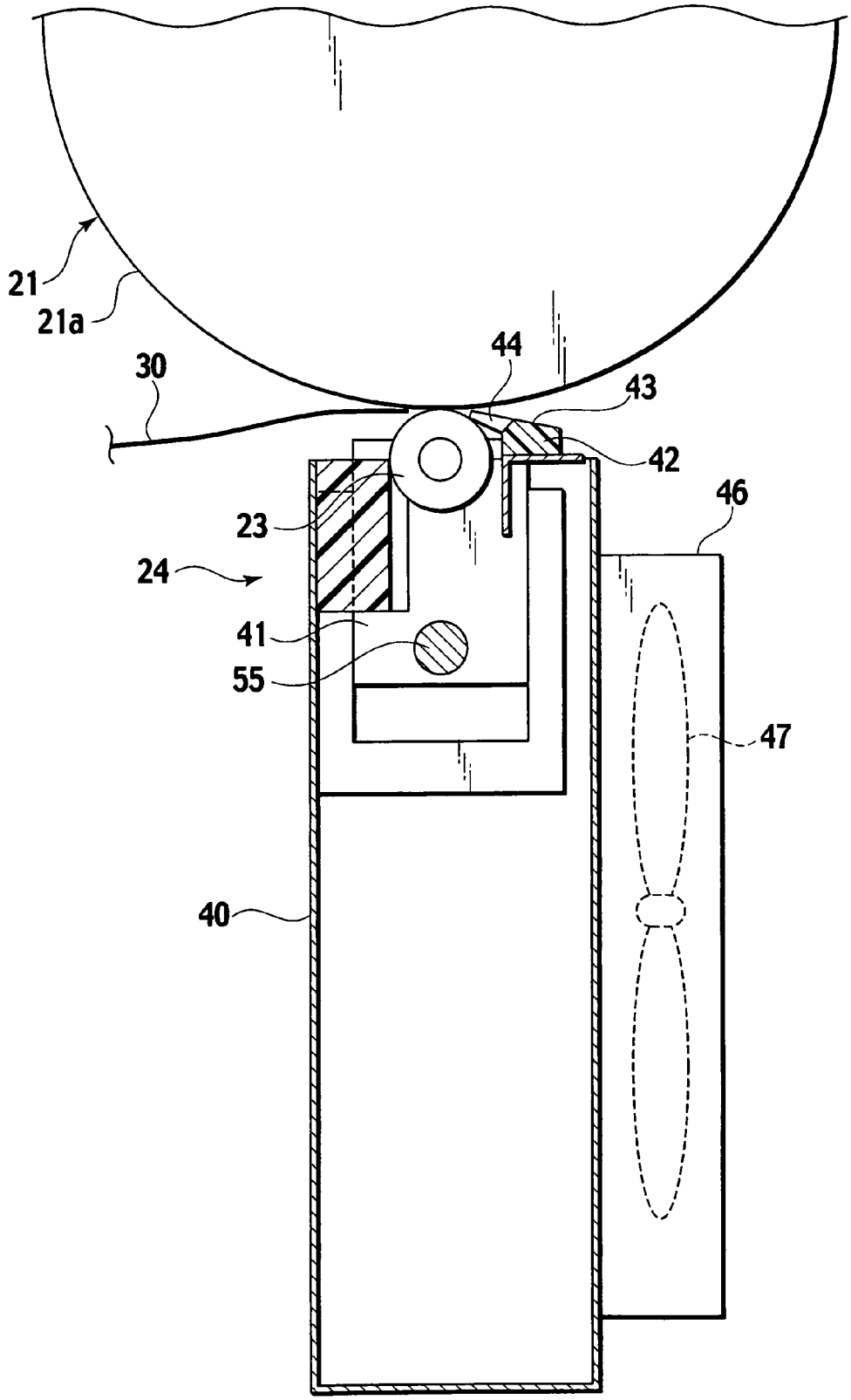
FIG. 7 shows the first embodiment of the present invention, and is a cross-sectional view along a line 7-7 in FIG. 6.
Figure 8:
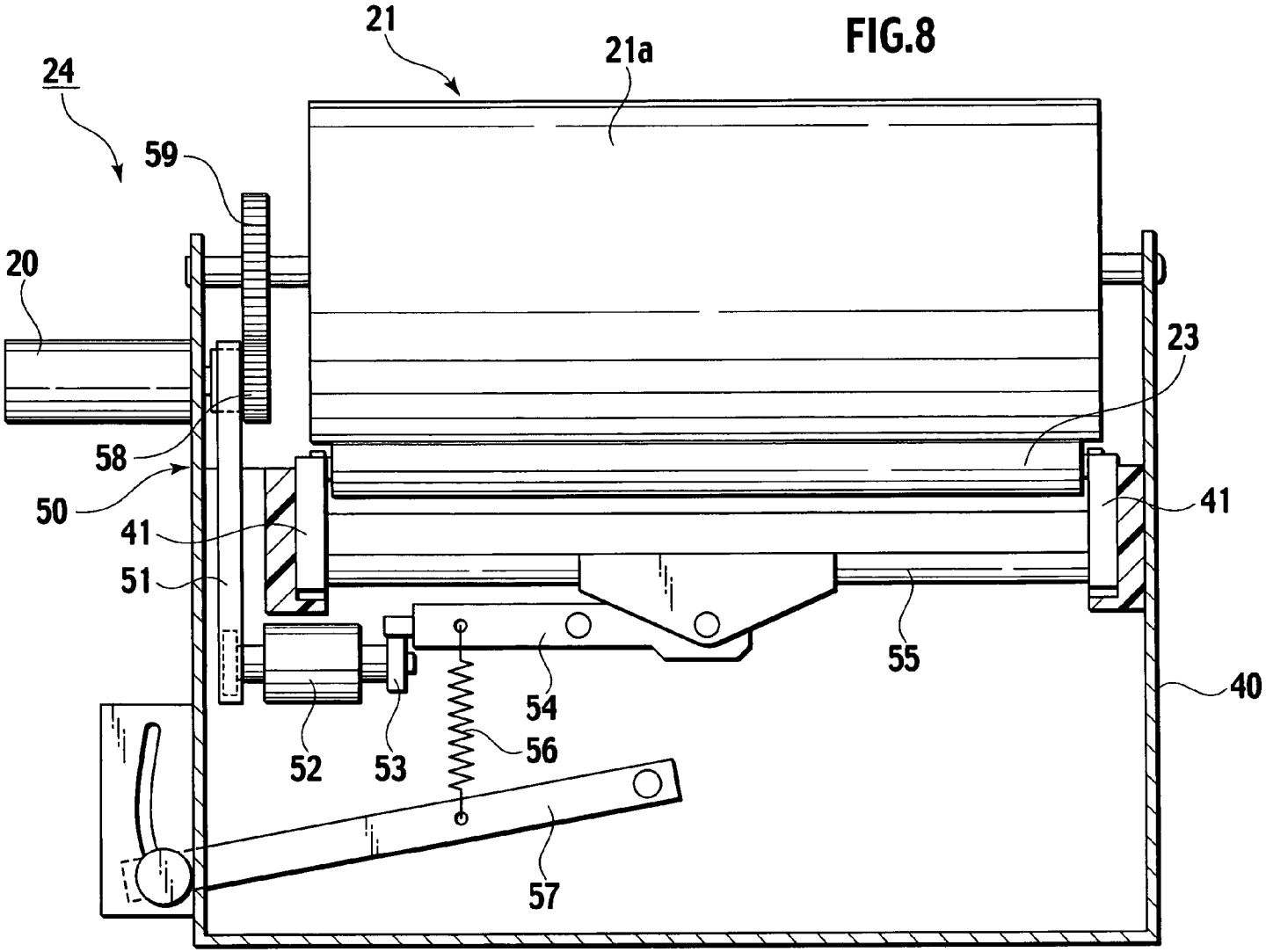
FIG. 8 shows the first embodiment of the present invention, and is a cross-sectional view along a line 8-8 in FIG. 6.

As shown in FIG. 4, a stencil printing machine 1 comprises mainly of an original reading unit (not shown), a stencil making unit 2, a printing unit 3, a paper feed unit 4, a paper discharge unit 5, and a stencil disposal unit 6.

The original reading unit includes an original setting tray, original conveyer rollers which convey an original mounted on the original setting tray, and a contact image sensor which optically reads image data of the original conveyed by the original conveyer rollers and converts the image data into electrical signals. Then, the original mounted on the original setting tray is conveyed by the original conveyer rollers, and the image sensor reads the image data of the conveyed original.

The stencil making unit 2 includes a stencil housing 11 which houses a long and rolled stencil sheet 10, a thermal print head 12 placed downstream of the stencil housing 11 in a conveying direction, a platen roller 13 placed at a position opposite to the thermal print head 12, a pair of stencil transfer rollers 14 and 14 placed downstream of the platen roller 13 and the thermal print head 12 in the conveying direction, a write pulse motor (not shown) which rotationally drives the platen roller 13 and the pair of stencil transfer rollers 14 and 14, and a stencil cutter 15 placed downstream of the pair of stencil transfer rollers 14 and 14 in the conveying direction.

The long stencil sheet 10 is conveyed by the rotations of the platen roller 13 and the pair of stencil transfer rollers 14 and 14. Based on the image data read by the image sensor, each of dot-shaped heating elements of the thermal print head 12 selectively performs a heating operation, and thus the stencil sheet 10 is perforated due to thermal sensitivity thereof to make a stencil. Then, the stencil sheet 10 thus made is cut by the stencil cutter 15 to make the stencil sheet 10 with a predetermined length.

The printing unit 3 includes a drum 21 which rotates in a direction of an arrow A of FIG. 4 by driving force of a motor 20, a stencil clamping portion 22 which is provided on an outer peripheral surface of the drum 21 and clamps a tip of the stencil sheet 10, ink supplying means (not shown) which supplies ink to a surface of an upper printing area of the drum 21, ink returning means (not shown) which returns extra ink overflown from a surface outside of the printing area of the drum 21, a pressure roller 23 placed below the drum, and a suction unit 24 which peels off a print sheet 30 on which an image is transferred in a manner that the print sheet 30 passes between the drum 21 and the pressure roller 23.

The drum 21 is configured to be rotationally driven by drum/pressure roller driving means 50 to be described later. Moreover, an outer peripheral wall 21*a* of the drum 21 has rigidity, and is formed of an ink impermeable member which does not allow the ink to permeate therethrough. Furthermore, the outer peripheral surface of the outer peripheral wall 21*a* is processed with a fluorine-contained resin coating process such as a Teflon (registered trademark) coating process, and is formed into an even cylindrical surface.

The stencil clamping portion 22 is supported on the outer peripheral wall 21*a* of the drum 21 so as to be freely rotatable, and is provided so as not to protrude from the outer peripheral wall 21*a* in a clamping state shown by a solid line in FIG. 4 while protruding from the outer peripheral wall 21*a* in a clamping release state shown by a virtual line in FIG. 4. Hence, the stencil clamping portion 22 is configured to be capable of clamping the stencil sheet 10 without protruding from the outer peripheral wall 21*a*.

The pressure roller 23 is configured to be shiftable between a press position of pressing the outer peripheral surface of the drum 21 and a standby position of being spaced from the outer peripheral surface of the drum 21 by the drum/pressure roller driving means 50 to be described later. The pressure roller 23 is always located at the press position during a period of a printing mode (including a trial print mode) and located at the standby position during a period other than the period of the printing mode.

Then, the tip of the stencil sheet 10 conveyed from the stencil making unit 2 is clamped by the stencil clamping portion 22, and the drum 21 is rotated in such a clamping state, so that the stencil sheet 10 is wound and attached around the outer peripheral surface of the drum 21. Then, the print sheets (print mediums) 30, which are fed by the paper feed unit 4 in synchronization with the rotation of the drum 21, are pressed to the stencil sheet 10 wound around the drum 21 by the pressure roller 23. Thus, the ink is transferred from perforations of the stencil sheet 10 onto the print sheets 30. Each of the print sheets 30 on which the image is printed is peeled off from the drum 21 by suction force of the suction unit 24.

The paper feed unit 4 includes a paper feed tray 31 on which the print sheets 30 are stacked, primary paper feed rollers 32 and 33 which convey only the uppermost print sheet 30 from the paper feed tray 31, and a pair of secondary paper feed rollers 34 and 34 which convey the print sheet 30, which has been conveyed by the primary paper feed rollers 32 and 33, between the drum 21 and the pressure roller 23 in synchronization with the rotation of the drum 21. The primary paper feed rollers 32 and 33 are configured such that the rotation of the motor 20 is selectively transmitted thereto through a paper feed clutch (not shown).

The paper discharge unit 5 includes a conveying passage 35 through which the print sheets 30 peeled off from the drum 21 are conveyed, and a paper receiving tray 36 on which the print sheets 30 discharged from the conveying passage 35 are stacked.

The stencil disposal unit 6 includes disposed stencil conveying means 37, and a stencil disposal box 38. The disposed stencil conveying means 37 guides the tip of the stencil sheet 10, of which clamping has been released from the outer peripheral surface of the drum 21, and conveys the used stencil sheet 10 thus guided while peeling off the same stencil sheet 10 from the drum 21. The stencil disposal box 38 houses the stencil sheet 10 conveyed by the disposed stencil conveying means 37.

Next, a configuration of the suction unit 24 is described. As shown in FIG. 5 to FIG. 8, the suction unit 24 includes a rectangular parallelepiped suction box 40 in which an inside is substantially hermetically sealed. On an upper portion of the suction box 40, a pair of movable side plates 41 and 41 are supported so as to be capable of freely ascending and descending. Between the pair of movable side plates 41 and 41, the pressure roller 23 is supported so as to be freely rotatable, and a suction port forming plate 42 is fixed. Specifically, the suction port forming plate 42 is configured to ascend and descend together with the pressure roller 23. The suction port forming plate 42 is placed at a position close to a downstream peripheral surface of the pressure roller 23 in the conveying direction, and an upper face (surface) of the suction port forming plate 42 is formed as a sheet conveying surface 43 which links the pressure roller 23 and the conveying passage 35 to each other.

Moreover, on the pressure roller 23 side of the suction port forming plate 42, notches are formed at an equal interval in a direction perpendicular to the sheet conveying direction, and suction ports 44 are provided by the notches and the peripheral surface of the pressure roller 23. Effective width D of the suction ports 44 is set at width larger than the maximum width of the feedable print sheets 30. The plurality of suction ports 44 are placed by being divided by a plurality of sheet suction preventing protrusions 45 placed in the sheet conveying direction.

A fan cover 46 is attached onto a back of the suction box 40, and a suction fan 47 is placed in the fan cover 46. When the suction fan 47 is driven, pressure in the suction box 40 is reduced, and by the reduced pressure, the air on the outer side of the sheet conveying surface 43 is sucked from the suction ports 44 into the suction box 40.

Moreover, the drum/pressure roller driving means 50 is attached onto the suction box 40. The drum/pressure roller driving means 50 has the motor 20 fixed to an outside position of the suction box 40, and the rotation of the motor 20 is guided to an input side of a clutch 52 through a timing belt 51. An eccentric cam 53 is coupled to an output side of the clutch 52, and one end of a swing arm 54 is placed above the eccentric cam 53. The other end of the swing arm 54 is coupled to a support shaft 55 which links the pair of movable side plates 41 and 41 to each other. Moreover, one end of a tensile coil spring 56 is hooked on the one end of the swing arm 54, and by spring force of the tensile coil spring 56, the pressure roller 23 is urged to a press position side. The other end of the tensile coil spring 56 is hooked on a printing pressure adjusting rod 57, and by operating the printing pressure adjusting rod 57, the printing pressure can be freely adjusted.

The driving force of the motor 20 is transmitted to the eccentric cam 53 by the clutch 52, and the eccentric cam 53 is brought to a position where the eccentric cam 53 concerned does not interfere with the one end of the swing arm 54. Then, the pressure roller 23 is located at the press position by using the spring force of the tensile coil spring 56 as pressing force. Meanwhile, the driving force of the motor 20 is transmitted to the eccentric cam 53 by the clutch 52, and the eccentric cam 53 is brought to a position where the eccentric cam 53 concerned interferes with the one end of the swing arm 54. Then, the swing arm 54 moves against the spring force of the tensile coil spring 56, and the pressure roller 23 is located at the standby position.

Furthermore, on an upper position of the pressure roller 23 in the suction box 40, the drum 21 is supported so as to be freely rotatable. The drum/pressure roller driving means 50 has a first gear 58 fixed to a rotational shaft of the motor 20, and the first gear 58 is engaged with a second gear 59 fixed to a support shaft of the drum 21. When the motor 20 rotates, the rotation of the motor 20 is transmitted to the drum 21 through the first gear 58 and the second gear 59, and thus the drum 21 rotates.

Next, operations of the above-described stencil printing machine 1 are briefly described.

First, when a stencil making mode is selected, in the stencil making unit 2, the stencil sheet 10 is conveyed by the rotations of the platen roller 13 and the pair of stencil transfer rollers 14 and 14. Based on the image data read by the original reading unit, the large number of heating elements of the thermal print head 12 selectively perform the heating operation, and thus the stencil sheet 10 is perforated due to the thermal sensitivity thereof to make the stencil. Then, the stencil sheet 10 thus made is cut at the predetermined spot by the stencil cutter 15. Thus, the stencil sheet 10 with the desired dimension is made.

In the printing unit 3, the tip of the stencil sheet 10 made in the stencil making unit 2 is clamped by the stencil clamping portion 22 of the drum 21, and the drum 21 is rotated in such a clamping state, so that the stencil sheet 10 is wound, attached and loaded around the outer peripheral surface 21*a* of the drum 21.

Next, when the printing mode is selected, in the printing unit 3, the drum 21 and the suction fan 47 are rotationally driven, and the ink supplying means and the ink returning means start driving. Then, the ink is supplied to the outer peripheral wall 21*a* of the drum 21, and the ink thus supplied is held between the outer peripheral wall 21*a* of the drum 21 and the stencil sheet 10, and the pressure roller 23 is shifted from the standby position to the press position.

The paper feed unit 4 feeds the print sheets 30 between the drum 21 and the pressure roller 23 in synchronization with the rotation of the drum 21. The print sheets 30 thus fed are pressed to the outer peripheral wall 21*a* of the drum 21 by the pressure roller 23, and conveyed by the rotation of the drum 21. Specifically, the print sheets 30 are conveyed while being brought into intimate contact with the stencil sheet 10.

Figure 9:
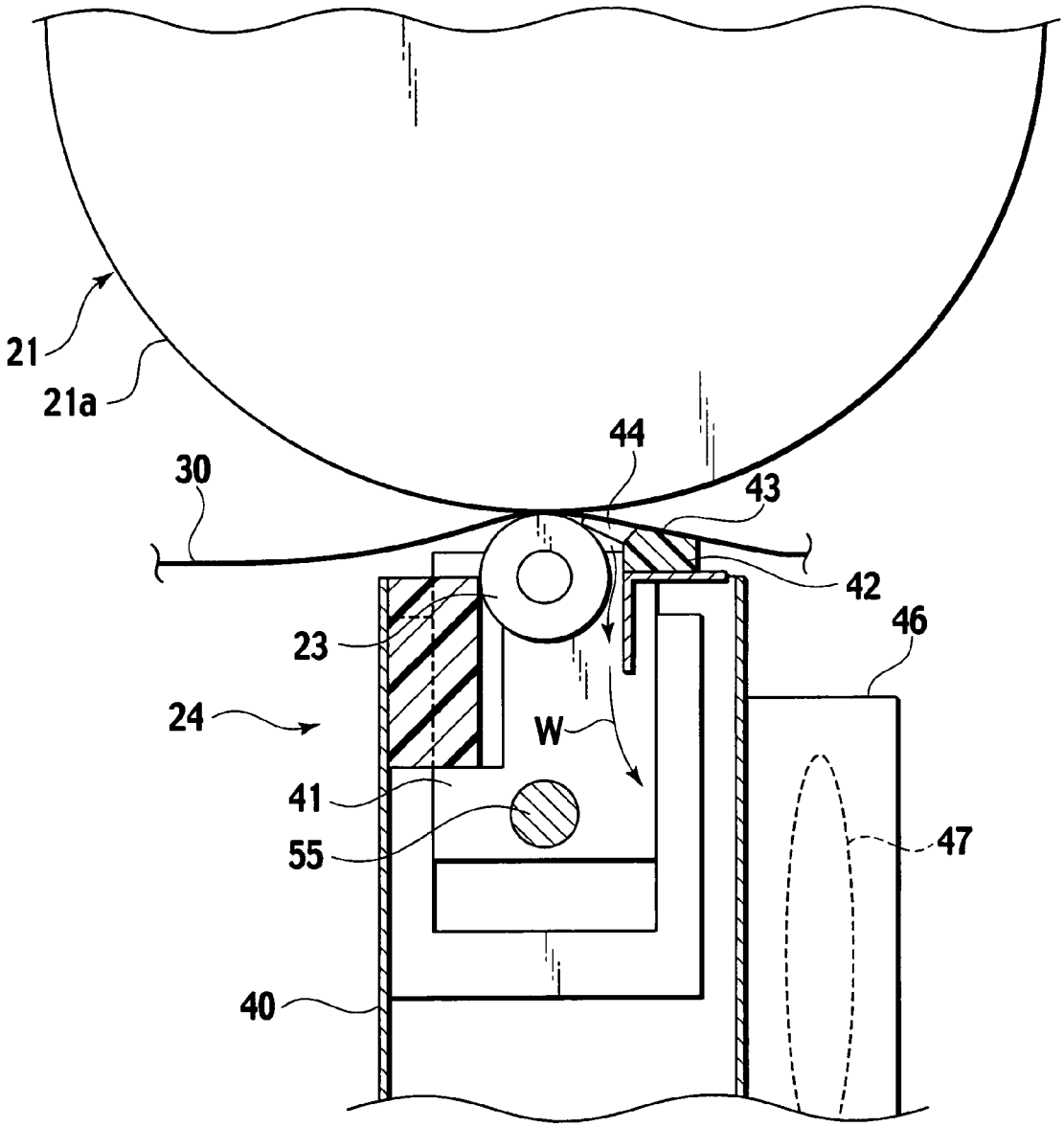
FIG. 9 shows the first embodiment of the present invention, and is a cross-sectional view of the suction unit and the like, explaining an operation of peeling off a print sheet from a drum.
Figure 10:
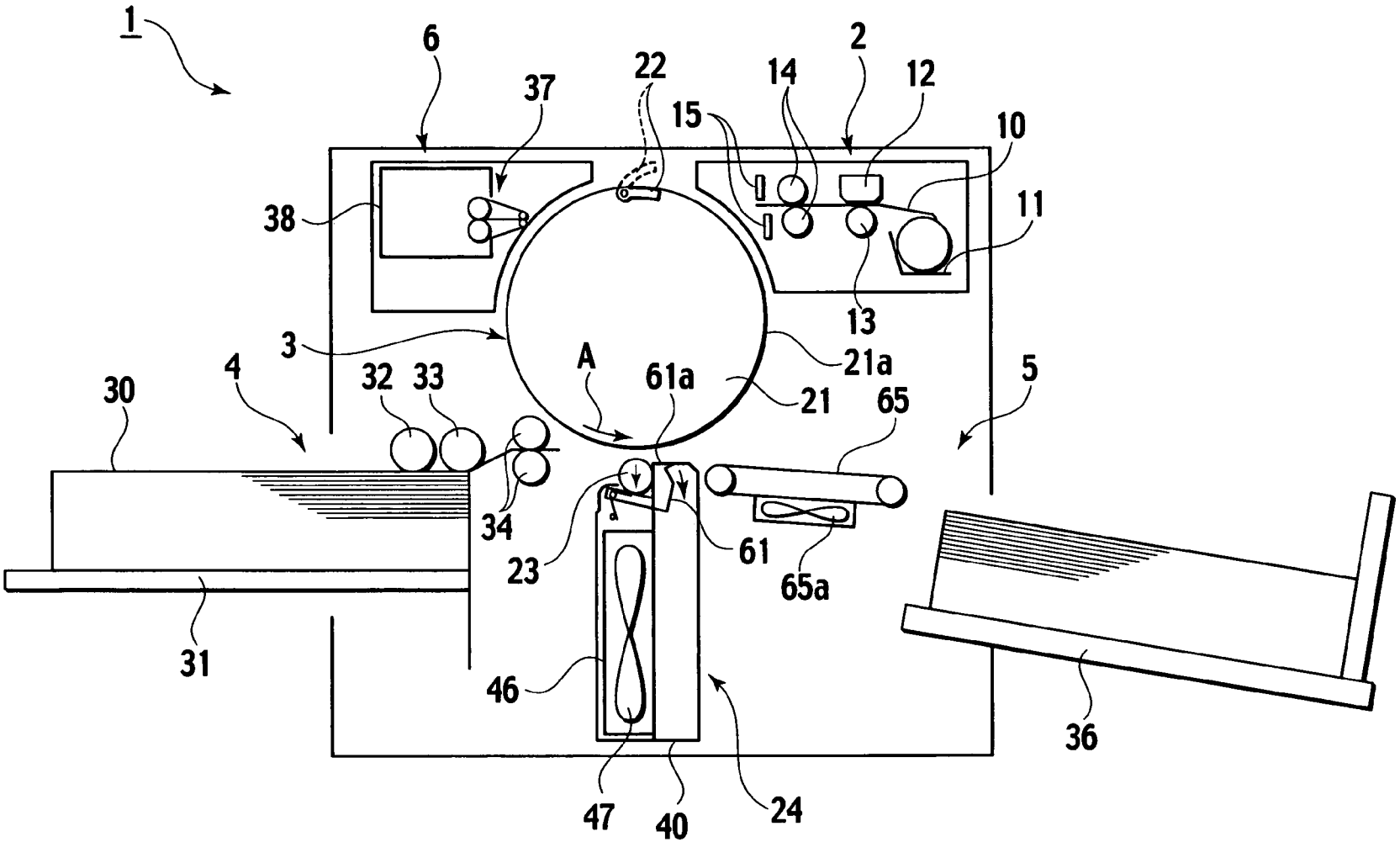
FIG. 10 shows a second embodiment of the present invention, and is a schematic configuration view of a stencil printing machine.
Figure 11:
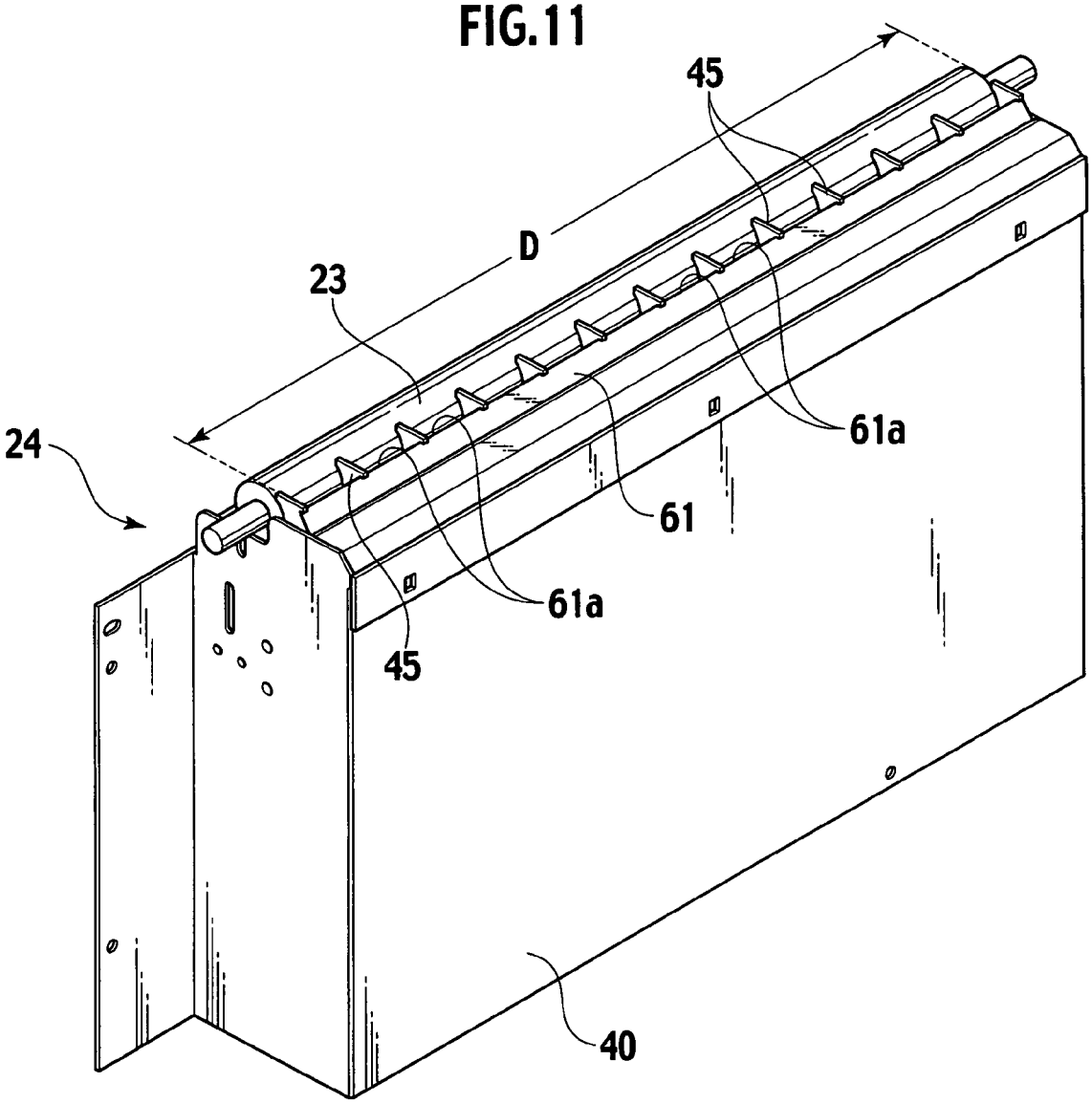
FIG. 11 shows the second embodiment of the present invention, and is a perspective view of a suction unit.
Figure 12:
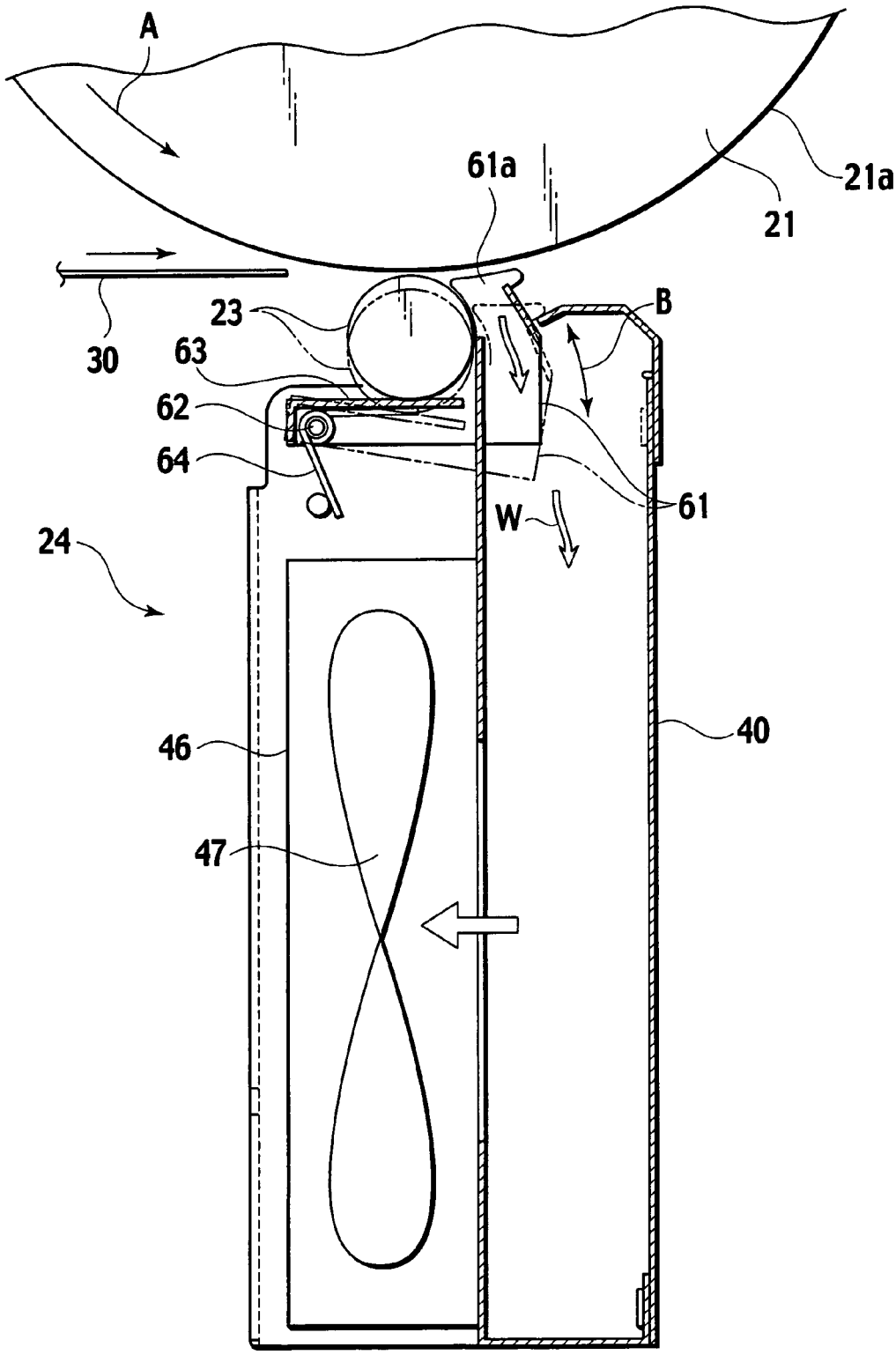
FIG. 12 shows the second embodiment of the present invention, and is a cross-sectional view of the suction unit.

At the same time when the print sheets 30 are conveyed, the ink held between the outer peripheral wall 21*a* of the drum 21 and the stencil sheet 10 is diffused downstream in a printing direction while being squeezed by the pressing force of the pressure roller 23. Moreover, the ink thus diffused oozes out of the perforations of the stencil sheet 10, and is transferred to the print sheets 30. In the manner described above, an ink image is printed on the print sheets 30 in the process where the print sheets 30 concerned pass between the outer peripheral wall 21*a* of the drum 21 and the pressure roller 23. As shown in FIG. 9, with regard to each print sheet 30 which has come out from between the outer peripheral wall 21*a* of the drum 21 and the pressure roller 23, the tip thereof is peeled off from the drum 21 by receiving a suction wind W from the suction ports 44. The print sheets 30 spaced from the drum 21 are discharged through the conveying passage 35 to the paper receiving tray 36, and are stacked there.

During the printing operations, extra ink which has flown downstream of the maximum printing area of the outer peripheral wall 21*a* of the drum 21 is returned by the ink returning means.

When printing of the set number of print sheets is completed, the rotations of the drum 21 and the suction fan 47 are stopped, and the drive of the ink supplying means is stopped. Thus, the supply of the ink to the outer peripheral wall 21*a* of the drum 21 is stopped. The drive of the ink returning means is stopped a little later than the stop of the ink supplying means, and the extra ink which has remained on the outer peripheral wall 21*a* of the drum 21 is returned by the ink returning means. Moreover, the pressure roller 23 is returned back to the standby position from the press position. After the operations described above are completed, the stencil printing machine 1 enters a standby mode.

When making of a new stencil sheet is started and so on and a stencil disposal mode is thus selected, the stencil clamping portion 22 of the drum 21 is shifted to a clamping release position. The tip of the stencil sheet 10, of which clamping has been released, is guided to the disposed stencil conveying means 37, following the rotation of the drum 21, and is then housed in the stencil disposal box 38.

Next, an operation of peeling off the print sheet 30 from the drum 21 in a process of the above-described operations is described. As shown in FIG. 9, the pressure roller 23 is located at the press position, and the tip of the print sheet 30 on which the image has been transferred is guided out from between the drum 21 and the pressure roller 23. Here, the suction ports 44 are placed at a position which is immediately after the printing pressure from the drum 21 and the pressure roller 23 is released and is sufficiently close to the drum 21. Moreover, when the print sheet 30 passes through the suction ports 44, the print sheet 30 is sucked with extremely strong suction force. Accordingly, the print sheet 30 is peeled off from the drum 21 only by the suction wind W. Hence, stain of the printing surface and a piercing accident of a separation claw in the drum 21, which are caused by use of the separation claw concerned, can be prevented. Moreover, the print sheet 30 is sucked from the suction ports 44 throughout the passing process thereof from the tip to the rear end in the conveying direction. Accordingly, as shown in FIG. 9, every spot of the print sheet 30 from the tip to the rear end in the conveying direction is always peeled off from the drum 21 at the position where the print sheet 30 comes out from the pressure roller 23. Hence, unevenness of the image owing to unevenness of the peeling-off timing of the print sheet 30 can be prevented.

In the above-described embodiment, the pressure roller 23 is freely movable between the press position of pressing the drum 21 and the standby position of being spaced from the drum 21, and the suction port forming plate 42 is provided so as to be freely movable together with the pressure roller 23. Accordingly, only at the time of performing the printing operations while setting the pressure roller 23 at the press position to the drum 21, the suction port forming plate 42 is placed at the position close to the drum 21, and at the other time, is shifted to the position of being spaced from the drum 21 together with the pressure roller 23. Therefore, the suction port forming plate 42 does not inhibit work of maintenance and exchange of the drum 21.

In the above-described embodiment, the effective width D of the suction ports 44 is set at the width larger than the maximum width of the feedable print sheets 30. Accordingly, the suction force can be applied to the entire width of the print sheets 30, and therefore, the print sheets 30 can be peeled off from the drum 21 surely and stably.

In the above-described embodiment, the suction ports 44 are placed by being divided by the plurality of sheet suction preventing protrusions 45 placed along the sheet conveying direction. Accordingly, the print sheets 30 are not sucked to the suction ports 44 by the suction force.

In the above-described embodiment, the suction port forming plate 42 is formed as a part of the suction box 40 which generates the suction wind W from the suction ports 44 in a manner that the pressure therein is reduced by the drive of the suction fan 47. Moreover, the pressure roller 23 is assembled to the suction box 40, and thus the suction unit 24 is configured. Accordingly, when the suction unit 24 is detached from a body of the machine and attached thereonto, the suction box 40 and the pressure roller 23 can be detached therefrom and attached thereonto. Hence, maintenance and exchange of the suction box 40 and the pressure roller 23 are easy. Moreover, the drum 21 is also assembled to the suction box 40, and accordingly, maintenance and exchange of the drum 21 are also easy.

In the above-described embodiment, the one is used as the drum 21, which has the outer peripheral wall 21*a* formed of the ink impermeable member and performs the image transfer on the print sheet 30 in a manner that the ink held between the surface of the outer peripheral wall 21*a* and the stencil sheet 10 is diffused while being squeezed by the pressure roller 23. However, one may also be used as the drum 21, which has an outer peripheral wall 21*a* formed of an ink permeable member and performs the image transfer on the print sheet 30 in a manner that ink supplied from an inner surface of the outer peripheral wall 21*a* is diffused and coated on the entire inner surface of the outer peripheral wall 21*a*.

Next, a stencil printing machine according to a second embodiment of the present invention is described with reference to FIG. 10 to FIG. 15.

In the second embodiment, the same reference numerals are assigned to the same configurations and functions as those of the first embodiment, and repetitive description is omitted.

In this embodiment, the pressure roller 23 is configured to be shiftable between the press position of pressing the outer peripheral surface of the drum 21 and the standby position of being spaced from the outer peripheral surface of the drum 21 by pressure roller driving means (not shown). The pressure roller 23 is always located at the press position during the period of the printing mode (including the trial print mode) and located at the standby position during the period other than the period of the printing mode.

The paper discharge unit 5 includes conveyor belt means 65 to which the print sheets 30 peeled off from the drum 21 are conveyed, a suction fan 65*a* for sucking the print sheets 30 onto a belt of the conveyor belt means 65, and the paper receiving tray 36 on which the print sheets 30 discharged from the conveyor belt means 65 are stacked.

Next, a configuration of the suction unit 24 is described. As shown in FIG. 11 to FIG. 15, the suction unit 24 includes the rectangular parallelepiped suction box 40 in which the inside is substantially hermetically sealed. On the upper portion of the suction box 40, a pair of movable side plates (not shown) are supported so as to be capable of freely ascending and descending. Between the pair of movable side plates, the pressure roller 23 is supported so as to be freely rotatable.

Moreover, on the upper position of the suction box 40, which is close to the downstream peripheral surface of the pressure roller 23 in the conveying direction, a suction nozzle 61 is placed. The suction nozzle 61 passes below the pressure roller 23, and has a rotation fulcrum portion 62 at a position upstream of the pressure roller 23 in the conveying direction. The suction nozzle 61 is provided so as to be freely movable between a suction position (solid-line position in FIG. 12) of approaching the drum 21 and a conveying track position (dotted-line position in FIG. 12, position in FIG. 15) where the suction nozzle 61 concerned is spaced from the drum 21 and reaches substantially the same height as that of a belt passage of the conveyor belt means 65 by swinging in a direction of an arrow B (shown in FIG. 12) about the rotation fulcrum portion 62.

Moreover, in the suction nozzle 61, an interfering/sliding member 63 which interferes with the lower surface of the pressure roller 23 is provided, and a spring 64 as urging means which urges the suction nozzle 61 to a suction position side is hooked thereon. Thus, the suction nozzle 61 is configured to move following the pressure roller 23. Specifically, when the pressure roller 23 is located at the press position, the suction nozzle 61 is located at the suction position by spring force of the spring 64 following the pressure roller 23. Meanwhile, when the pressure roller 23 is located at the standby position, the suction nozzle 61 shifts to the conveying track position against the spring force of the spring 64 following the pressure roller 23. However, when being located at the suction position, the suction nozzle 61 is movable to the conveying track position against the spring force of the spring 64. The spring force of the spring 64 is set at force weaker than suction force F applied to the suction nozzle 61 in a state of being closed by the print sheet 30.

Moreover, effective width D of the suction nozzle 61 is set at width larger than the maximum width of the feedable print sheets 30. A plurality of suction ports 61*a* of the suction nozzle 61 are placed by being divided by the plurality of sheet suction preventing protrusions 45 placed in the sheet conveying direction.

The fan cover 46 is attached onto the back of the suction box 40, and the suction fan 47 is placed in the fan cover 46. When the suction fan 47 is driven, the pressure in the suction box 40 is reduced, and by the reduced pressure, the air on the outer side (drum 21 side) is sucked from the suction ports 61*a* of the suction nozzle 61 into the suction box 40.

Next, operations of the above-described stencil printing machine 1 are briefly described. Description for repetitive portions from the first embodiment is omitted.

In this embodiment, at the same time when the print sheets 30 are conveyed, the ink held between the outer peripheral wall 21*a* of the drum 21 and the stencil sheet 10 is diffused downstream in the printing direction while being squeezed by the pressing force of the pressure roller 23. Moreover, the ink thus diffused oozes out of the perforations of the stencil sheet 10, and is transferred to the print sheets 30. In the manner described above, the ink image is printed on the print sheets 30 in the process where the print sheets 30 concerned pass between the outer peripheral wall 21*a* of the drum 21 and the pressure roller 23. With regard to each print sheet 30 which has come out from between the outer peripheral wall 21*a* of the drum 21 and the pressure roller 23, the tip thereof is peeled off from the drum 21 by receiving the suction wind W from the suction nozzle 61. The print sheets 30 spaced from the drum 21 are discharged through the conveyor belt means 65 to the paper receiving tray 36, and are stacked there.

Figure 13:
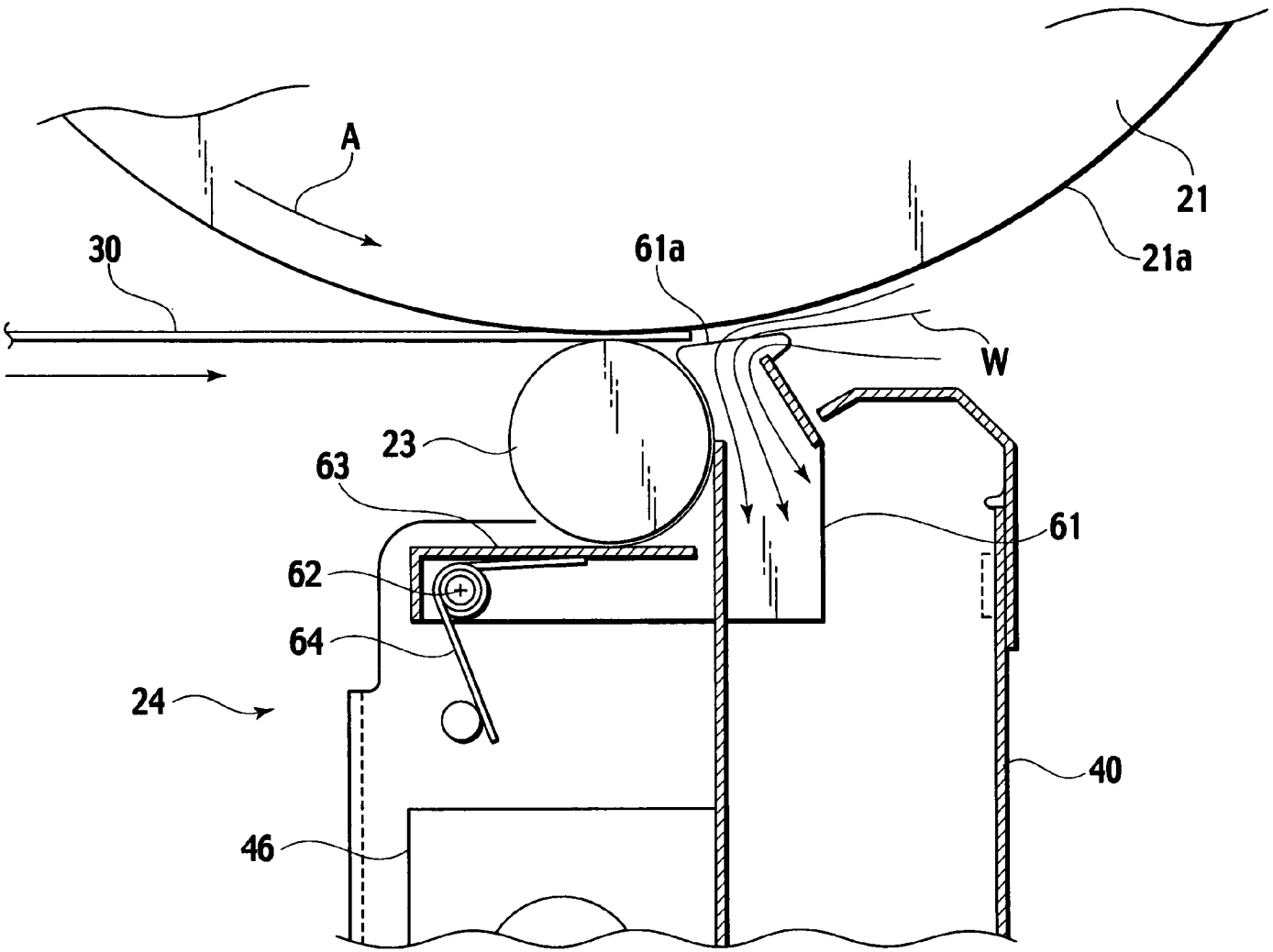
FIG. 13 shows the second embodiment of the present invention, and is a cross-sectional view of a state where a tip of the print sheet is conveyed to a position of arriving above a suction nozzle.
Figure 14:
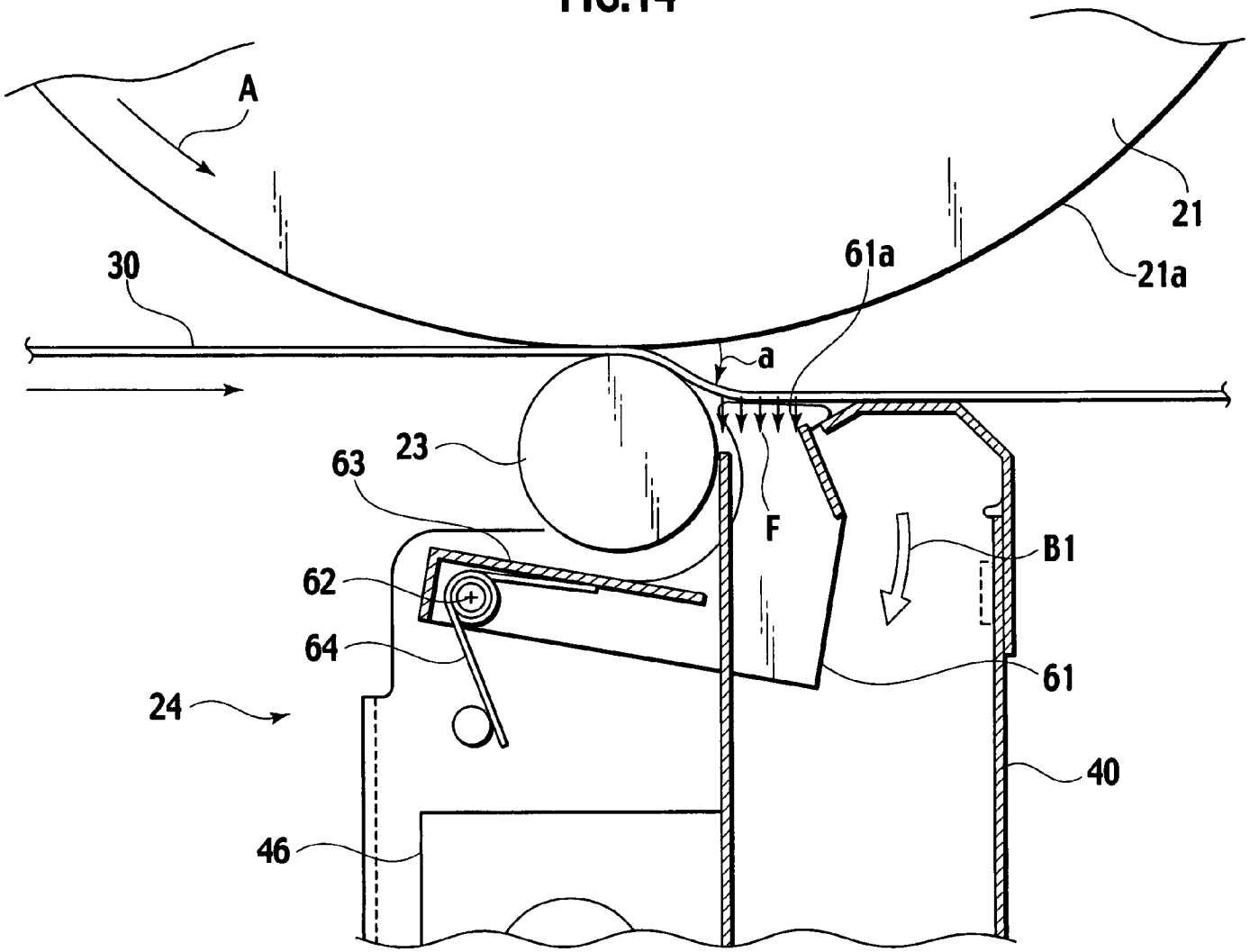
FIG. 14 shows the second embodiment of the present invention, and is a cross sectional view of a state where the tip of the print sheet has passed the suction nozzle and the suction nozzle is located at a position on a conveying track of the print sheet.
Figure 15:
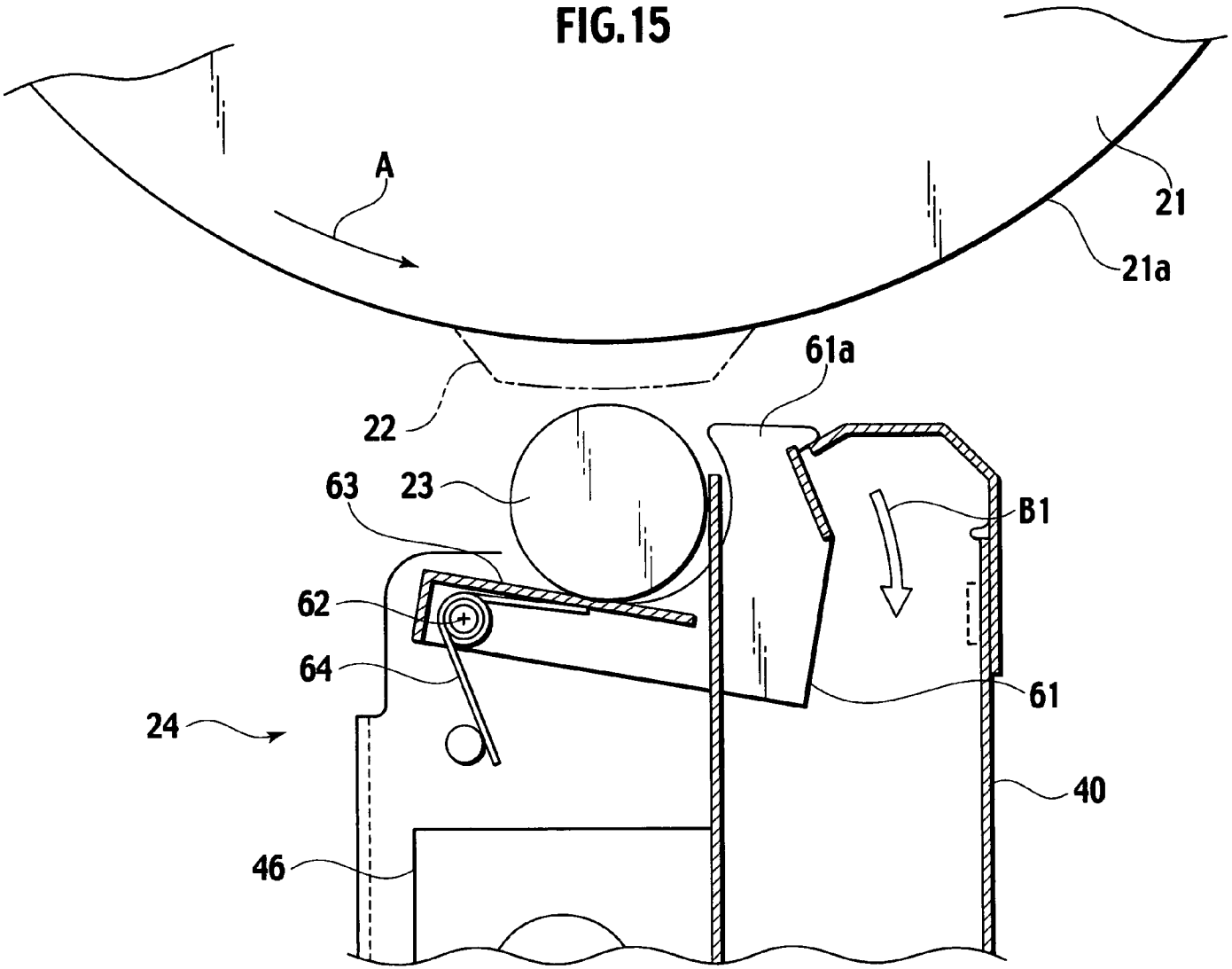
FIG. 15 shows the second embodiment of the present invention, and is a cross-sectional view of a state where a pressure roller is located at a standby position.

Next, an operation of peeling off the print sheet 30 from the drum 21 in a process of the above-described operations is described. As shown in FIG. 13, the suction nozzle 61 is located at the suction position. In this state, the tip of the print sheet 30 is guided out from between the drum 21 and the pressure roller 23. Here, the suction nozzle 61 is placed at a position which is immediately after the printing pressure from the drum 21 and the pressure roller 23 is released and is sufficiently close to the drum 21. Accordingly, the tip of the print sheet 30 is sucked by the suction nozzle 61 with the extremely strong suction force F. When the print sheet 30 gradually closes the suction ports 61*a* of the suction nozzle 60, and the suction force F applied to the suction nozzle 61 exceeds the spring force of the spring 64, the suction nozzle 61 moves to a direction of an arrow B1 of FIG. 14 in a state of sucking the tip of the print sheet 30 in the conveying direction, thereby shifting to the conveying track position. Then, as shown in FIG. 14, the tip of the print sheet 30 in the conveying direction is peeled off from the drum 21, and is changed onto a track having a large peeling angle a with respect the drum 21. The suction force F of the suction nozzle 61 works efficiently to peel off the print sheet 30 conveyed on the conveying track having the large peeling angle a with respect to the drum 21. Accordingly, a stable peeling track is obtained. Hence, the stain of the printing surface and the piercing accident of the separation claw in the drum 21, which are caused by use of the separation claw concerned, can be prevented. Moreover, every spot of the print sheet 30 from the tip to the rear end in the conveying direction is surely peeled off from the drum 21 at the position where the print sheet 30 comes out from the pressure roller 23. Hence, the unevenness of the image owing to the unevenness of the peeling-off timing of the print sheet 30 can be prevented.

In the above-described embodiment, the pressure roller 23 is freely movable between the press position of pressing the drum 21 and the standby position of being spaced from the drum 21, and the suction nozzle 61 is provided so as to be freely movable together with the pressure roller 23. Accordingly, only at the time of performing the printing operations while setting the pressure roller 23 at the press position to the drum 21, the suction nozzle 61 is placed at the position close to the drum 21, and at the other time, moves to the direction of the arrow B1 together with the pressure roller 23 and is shifted to the conveying track position of being spaced from the drum 21. Therefore, the suction nozzle 61 does not inhibit the work of maintenance and exchange of the drum 21. For example, as shown by a virtual line in FIG. 15, when the stencil clamping portion 22 is placed at a position protruding from the outer peripheral surface of the drum 21, the suction nozzle 61 moves in the direction of the arrow B1 following the movement of the pressure roller 23. Therefore, it is not necessary to take separate measures for avoiding interference with the stencil clamping portion 22.

In the above-described embodiment, the suction ports 61*a* of the suction nozzle 61 are placed by being divided by the plurality of sheet suction preventing protrusions 45 placed along the sheet conveying direction. Accordingly, the print sheets 30 are not sucked to the suction ports 61*a* by the suction force F.

In the above-described embodiment, the conveying track position of the suction nozzle 61 is set at substantially the same height as that of the belt passage of the conveyor belt means 65. Accordingly, the print sheet 30 guided out from between the drum 21 and the pressure roller 23 is smoothly conveyed to the belt passage of the paper discharge unit 5.

Figure 16:
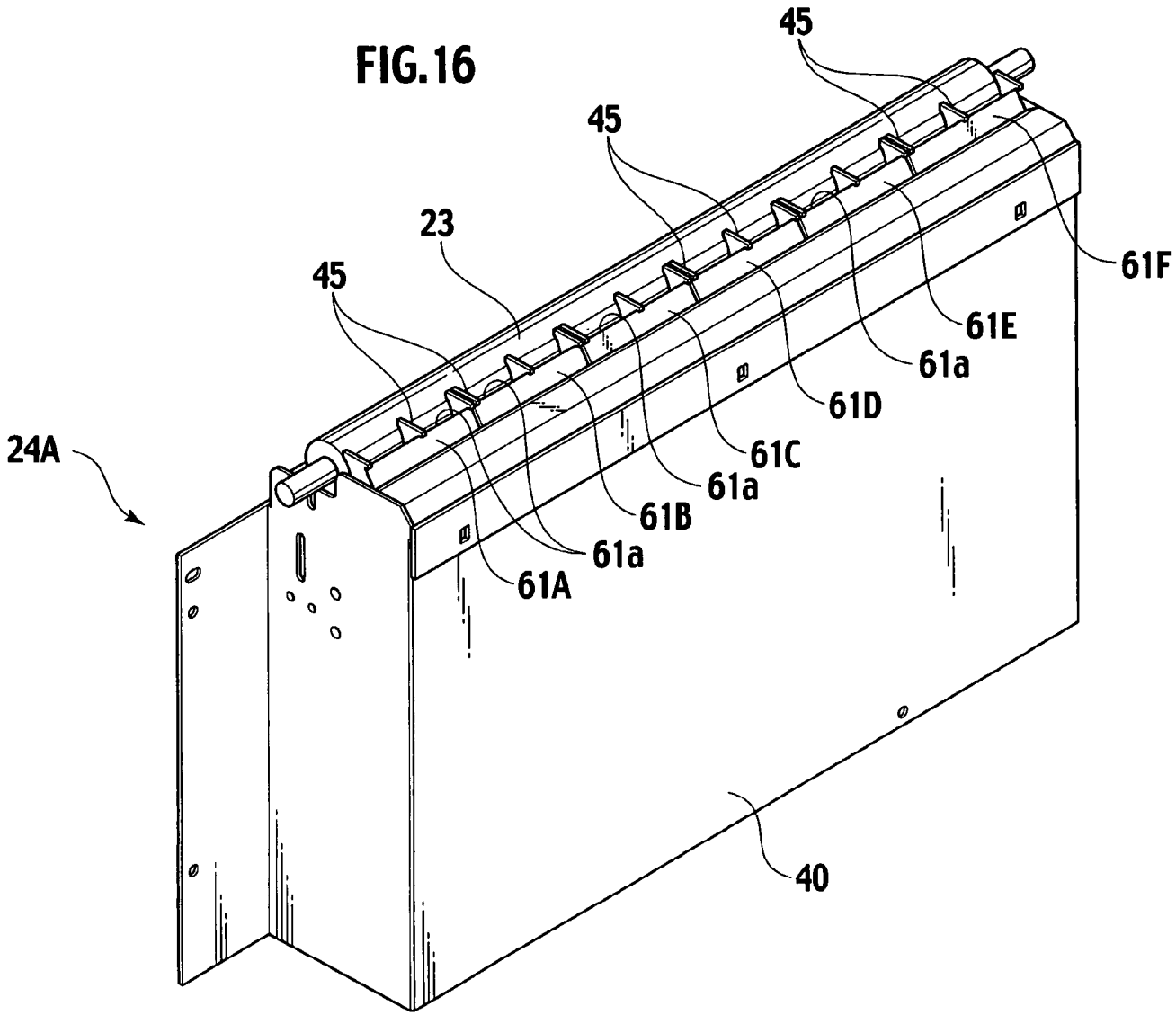
FIG. 16 shows a third embodiment of the present invention, and is a perspective view of a suction unit.

FIG. 16 shows a third embodiment, and is a perspective view of a suction unit 24A. As shown in FIG. 16, a plurality of suction nozzles 61A to 61F are placed by being divided along the direction perpendicular to the sheet conveying direction. Moreover, springs (not shown) as urging means for urging the respective suction nozzles 61A to 61F to the conveying track position side are individually hooked thereon, and each of the suction nozzles 61A to 61F is configured to move independently of the others. Other configurations are similar to those of the first embodiment, and accordingly, repetitive description is omitted.

In this third embodiment, when a print sheet passes through the suction nozzles 61A to 61F, only the suction nozzles 61A to 61F which correspond to width of the print sheet shift from the suction position to the conveying track position, and the other suction nozzles 61A to 61F remain at the suction position close to the drum. Accordingly, unnecessary suction of the air can be restricted, lowering of the suction force can be restricted to the minimum, and the stable peeling track can be maintained.

Figure 17:
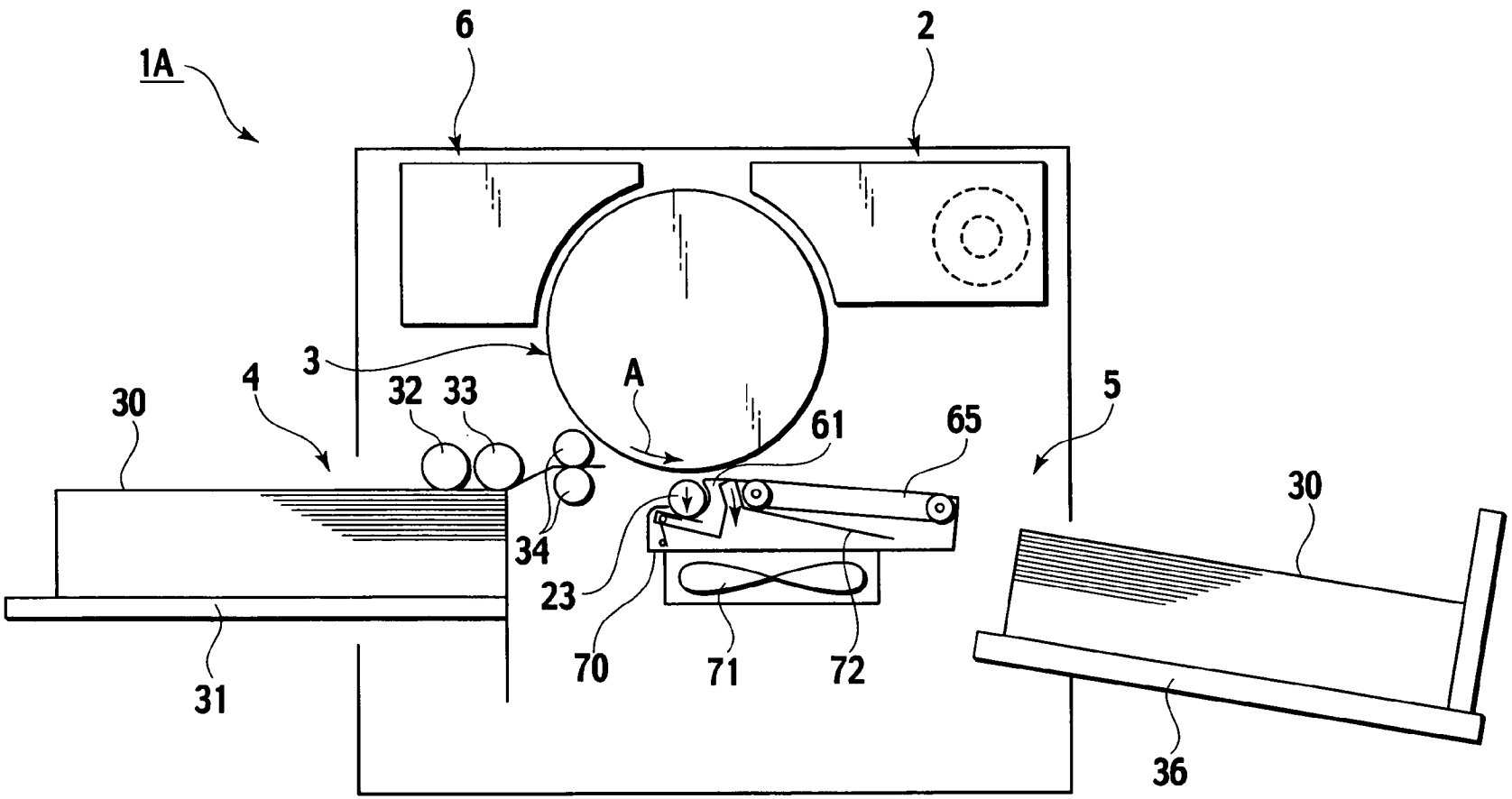
FIG. 17 shows a fourth embodiment of the present invention, and is a schematic configuration view of a stencil printing machine.
Figure 18:
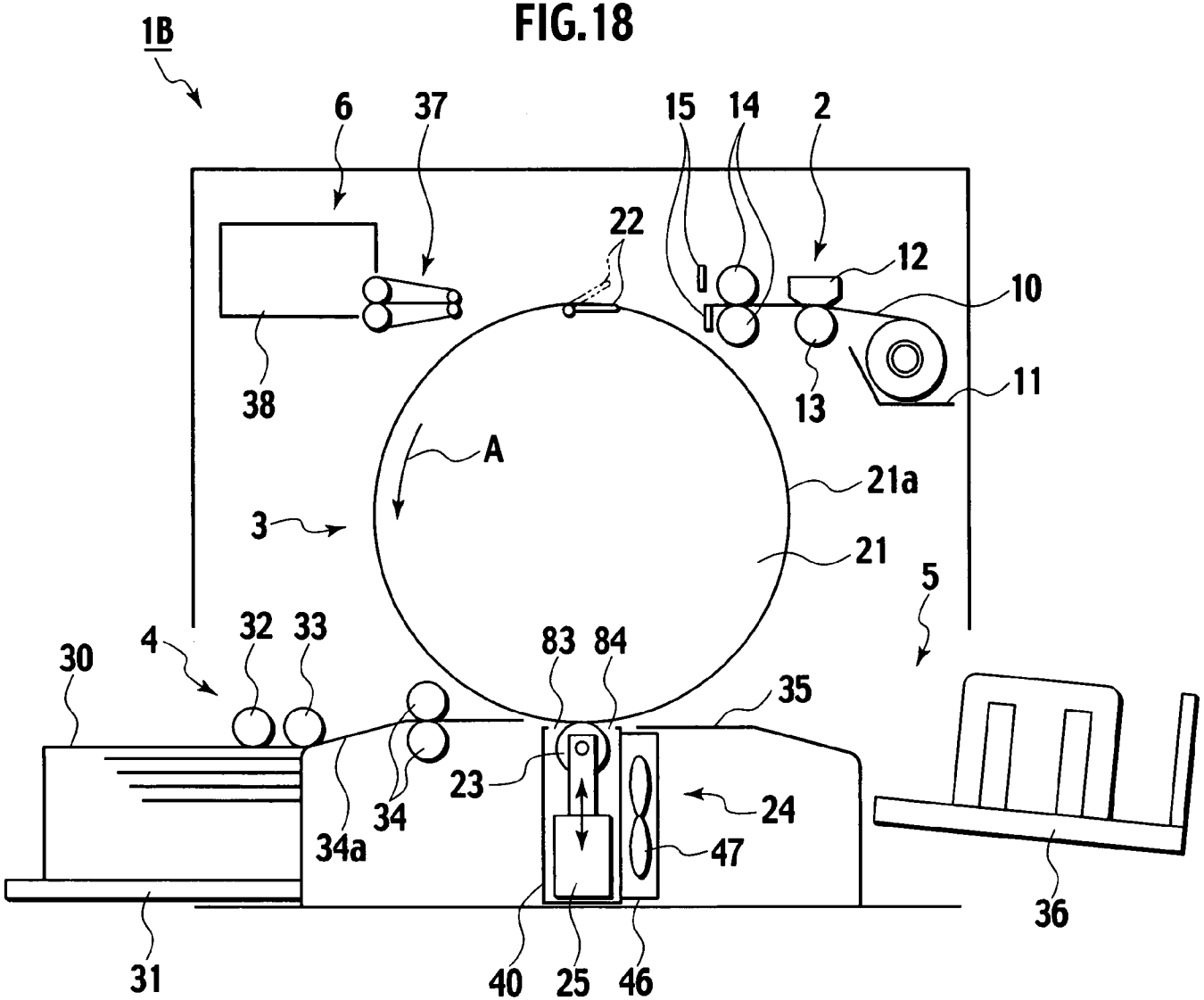
FIG. 18 shows a fifth embodiment of the present invention, and is a schematic configuration view of a stencil printing machine.
Figure 19:
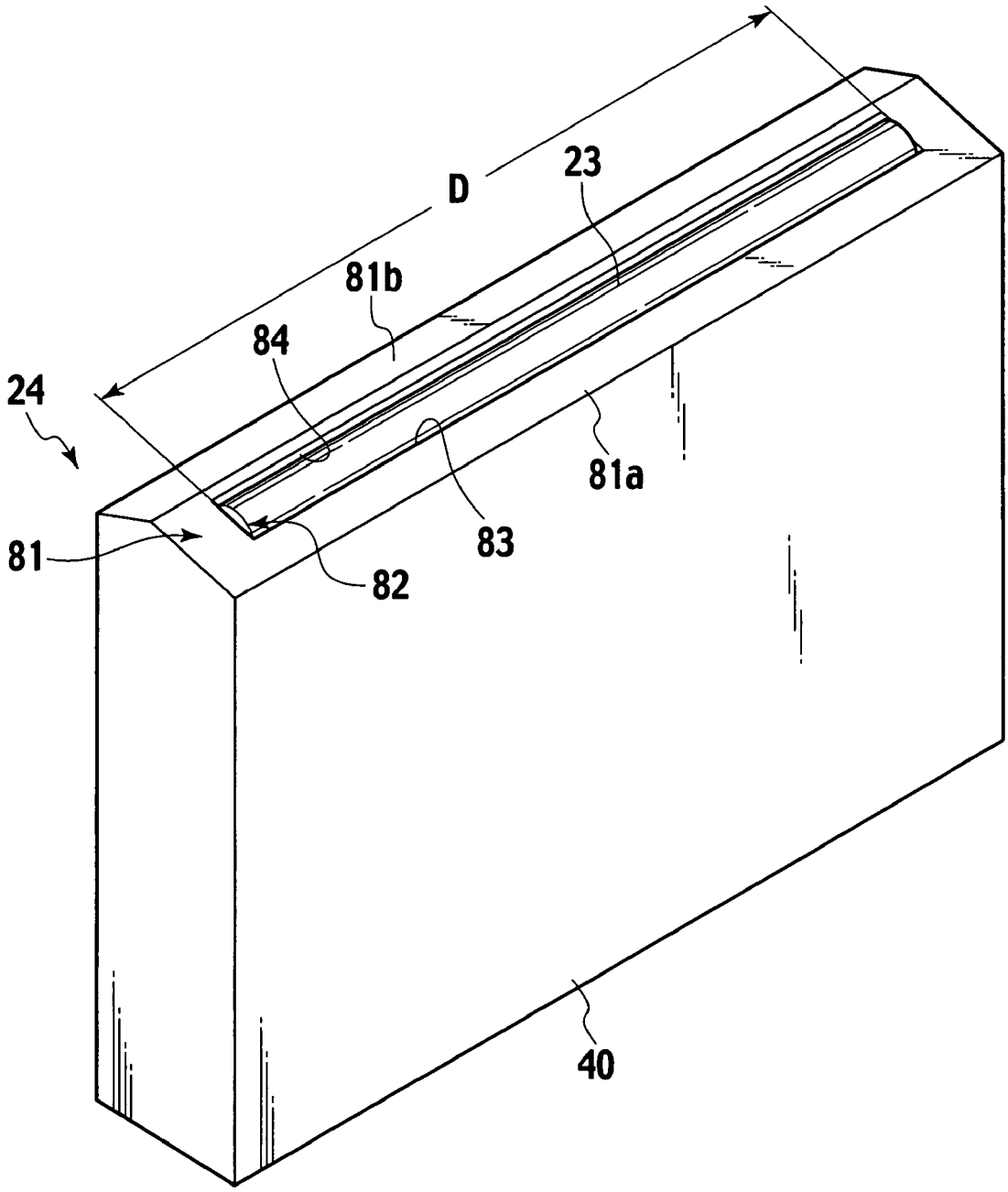
FIG. 19 shows the fifth embodiment of the present invention, and is a perspective view of a suction unit.
Figure 20:
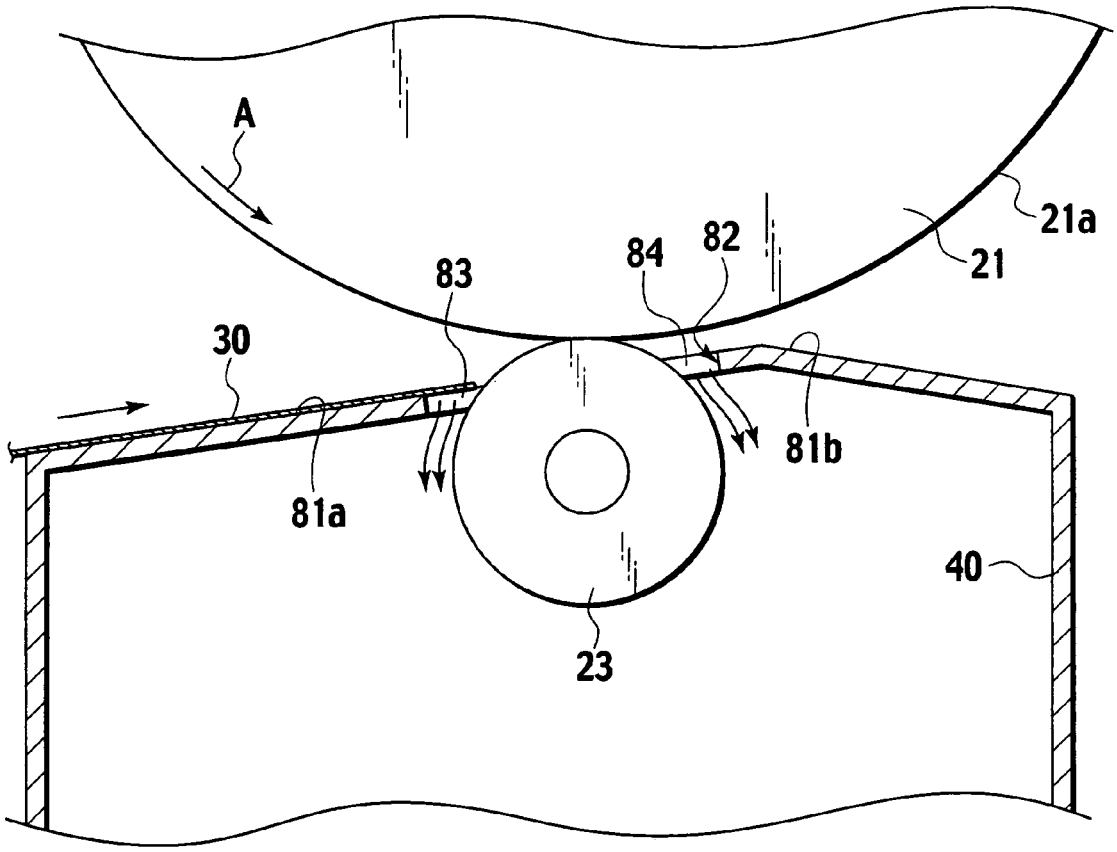
FIG. 20 shows the fifth embodiment of the present invention, and is a cross-sectional view of principal portions, showing a state where the tip of the print sheet is conveyed while being sucked by a feed-side suction port.

FIG. 17 shows a fourth embodiment, and is a schematic configuration view of a stencil printing machine 1A. As shown in FIG. 17, a suction box 70 has a size which covers not only the suction nozzle 61 but also the entire lower surface of the conveyor belt means 65, and in the suction box 70, a single suction fan 71 which reduces pressure therein is placed. A suction port (not shown) is formed on a lower surface of the suction nozzle 61 and the conveyor belt means 65. A suction force adjusting plate 72 is placed in the suction box 70, and by the suction force adjusting plate 72, a suction ratio of suction force on the suction nozzle 61 side and suction force on the conveyor belt means 65 side is adjusted.

Other configurations are the same as those of the first embodiment. Accordingly, the same reference numerals are assigned to the same constituent portions in FIG. 17, and repetitive description is omitted.

In this fourth embodiment, the suction from the suction nozzle 61 and the suction from the conveyor belt means 65 are performed by the same suction fan 71, and accordingly, reduction, simplification of a structure and the like of the suction fan 71 can be achieved. Moreover, both of the suction forces are adjusted at desired ones by the suction force adjusting plate 72.

In the above-described embodiment, the one is used as the drum 21, which has the outer peripheral wall 21*a* formed of the ink impermeable member and performs the image transfer on the print sheet 30 in a manner that the ink held between the surface of the outer peripheral wall 21*a* and the stencil sheet 10 is diffused while being squeezed by the pressure roller 23. However, one may also be used as the drum 21, which has an outer peripheral wall 21*a* formed of an ink permeable member and performs the image transfer on the print sheet 30 in a manner that ink supplied from an inner surface of the outer peripheral wall 21*a* is diffused and coated on the entire inner surface of the outer peripheral wall 21*a*.

Next, a stencil printing machine according to a fifth embodiment of the present invention is described by use of FIG. 18 to FIG. 21. In this embodiment, the same reference numerals are assigned to the same configurations and functions as those of the first embodiment, and repetitive description is omitted.

In this embodiment, the pressure roller 23 is configured to be shiftable between the press position of pressing the outer peripheral surface of the drum 21 and the standby position of being spaced from the outer peripheral surface of the drum 21 by an electromagnetic solenoid 25 as the pressure roller driving means. The pressure roller 23 is always located at the press position during the period of the printing mode (including the trial print mode) and located at the standby position during the period other than the period of the printing mode.

Next, a configuration of the suction unit 24 is described. As shown in FIG. 18 to FIG. 21, the suction unit 24 includes the rectangular parallelepiped suction box 40 in which the inside is substantially hermetically sealed. On an upper surface of the suction box 40, an upper surface plate 81 is provided, and in the upper surface plate 81, an opening portion 82 is formed. In the opening portion 82, the pressure roller 23 assembled to the suction box 40 is placed so as to freely go back and forth.

An upper surface of the upper surface plate 81, which is on the upstream side of the pressure roller 23 in the conveying direction, is formed as a feed-side sheet conveying surface 81*a* for the print sheets 30. The feed-side sheet conveying surface 81*a* is formed as an inclined surface with respect to the horizontal direction, and the print sheets 30 enter the position between the drum 21 and the pressure roller 23 at a desired angle. Moreover, an upper surface of the upper surface plate 81, which is on the downstream side of the pressure roller 23 in the conveying direction, is formed as a discharge-side sheet conveying surface 81*b*.

Moreover, a dimension of the opening portion 82 in the sheet conveying direction is set at width to an extent where the pressure roller 23 does not contact the opening portion 82 when being located at the press position. By partial use of the opening portion 82, a feed-side suction port 83 is formed on the upstream side of the pressure roller 23 in the conveying direction, and a discharge-side suction port 84 is formed on the downstream side of the pressure roller 23 in the conveying direction. Specifically, the feed-side suction port 83 and the discharge-side suction port 84 are formed of the opening portion 82 with an upstream peripheral surface of the pressure roller 23 in the conveying direction and a downstream peripheral surface of the pressure roller 23 in the conveying direction taken as hole surfaces, respectively. The respective effective widths D of the feed-side suction port 83 and the discharge-side suction port 84 are set at the width larger than the maximum width of the feedable print sheets 30.

The fan cover 46 is attached onto the back of the suction box 40, and the suction fan 47 is placed in the fan cover 46. When the suction fan 47 is driven, the pressure in the suction box 40 is reduced, and by the reduced pressure, the air on the outer sides of the respective sheet conveying surfaces 81*a* and 81*b* is sucked from the feed-side suction port 83 and the discharge-side suction port 84.

Next, a feed operation of feeding the print sheet 30 between the drum 21 and the pressure roller 23 in a process of the above-described operations is described. By rotational forces of the primary feed rollers 32 and 33, the uppermost print sheet 30 stacked on the paper feed tray 31 is conveyed to between the pair of secondary feed rollers 34 and 34 along a feed-side sheet conveying surface 34*a*. Next, by rotational forces of the pair of secondary feed rollers 34 and 34 rotated in synchronization with the rotation of the drum 21, the print sheet is fed to between the drum 21 and the pressure roller 23 along the feed-side sheet feeding surface 34*a* and a feed-side sheet conveying surface 81*a* subsequent thereto. Here, as show in FIG. 20, when the tip of the print sheet 30 arrives on the feed-side suction port 83, the tip of the print sheet 30 is conveyed along the feed-side sheet conveying surface 81*a* by receiving suction force of the feed-side suction port 83. Specifically, the tip of the print sheet 30 is fed through an appropriate conveying track without bending to the drum 21 side and the like. Hence, a wrinkle and a crease do not occur on the print sheet 30 owing to unstable paper feed, or an image ghost does not occur owing to a contact of the print sheet 30 with the drum 21.

Figure 21:
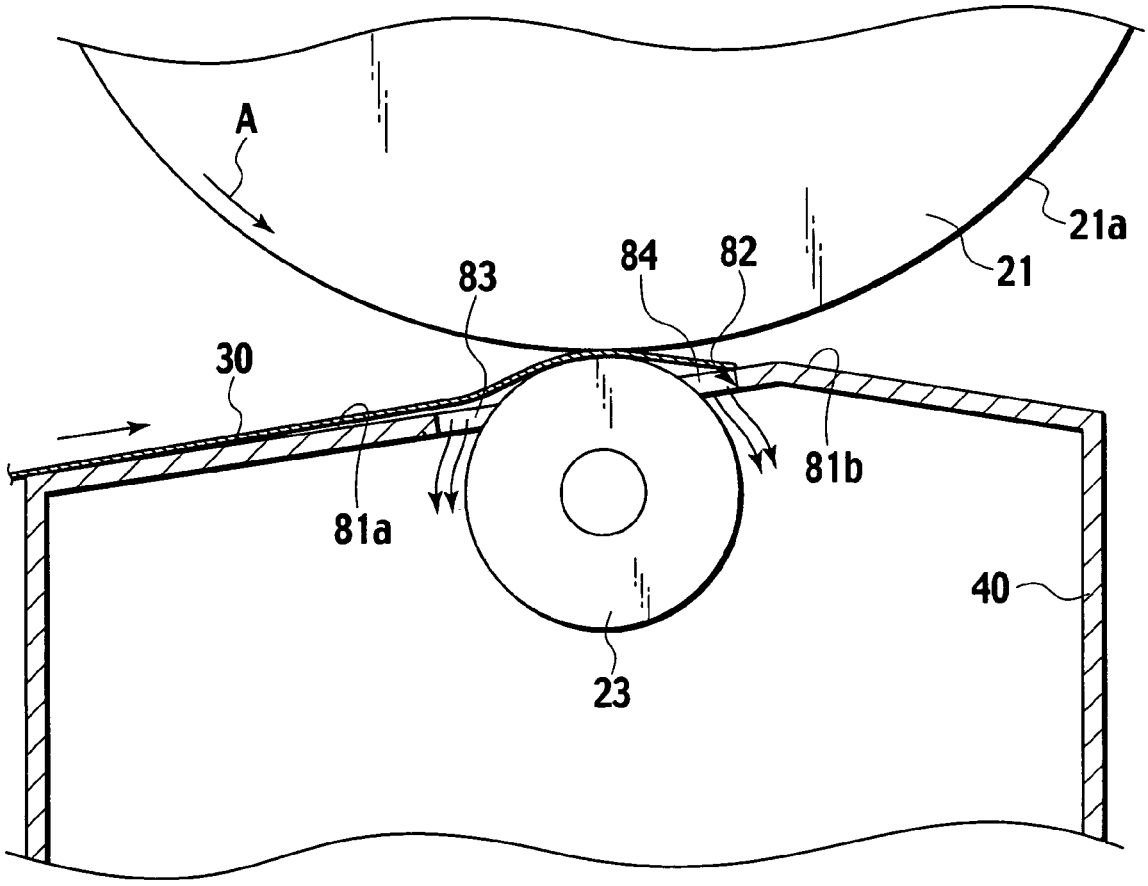
FIG. 21 shows the fifth embodiment of the present invention, and is a cross-sectional view showing a state where the print sheet is sucked by a discharge-side suction port and peeled off from a drum.

Next, an operation of peeling off the print sheet 30 from the drum 21 in a process of the above-described operations is described. As shown in FIG. 21, when the tip of the print sheet 30 is guided out from between the drum 21 and the pressure roller 23, the tip passes above the discharge-side suction port 84. Then, the print sheet 30 is peeled off from the drum 21 by suction force of the discharge-side suction port 84. Hence, the stain of the printing surface and the piercing accident of the separation claw in the drum 21, which are caused by use of the separation claw concerned, can be prevented. Moreover, the print sheet 30 is sucked from the discharge-side suction port 84 throughout the passing process thereof from the tip to the rear end in the conveying direction. Accordingly, every spot of the print sheet 30 from the tip to the rear end in the conveying direction is always peeled off from the drum 21 at the position where the print sheet 30 comes out from the pressure roller 23. Hence, the unevenness of the image owing to the unevenness of the peeling-off timing of the print sheet 30 can be prevented.

In the above-described embodiment, the feed-side suction port 83 is formed with the upstream peripheral surface of the pressure roller 23 in the conveying direction taken as the hole surface. Accordingly, the print sheet 30 is sucked by the feed-side suction port 83 at the position immediately before the print sheet 30 concerned is fed between the drum 21 and the pressure roller 23. Therefore, the tip of the print sheet 30 can be surely prevented from being fed in a bending state. Hence, the occurrence of the wrinkle and the crease on the print sheet 30 and the occurrence of the image ghost owing to the contact of the print sheet 30 with the drum 21 can be prevented effectively.

In the above-described embodiment, the discharge-side suction port 84 is formed with the downstream peripheral surface of the pressure roller 23 in the conveying direction taken as the hole surface. Accordingly, the print sheet 30 can be sucked by the discharge-side suction port 84 at the position immediately after the printing pressure from the drum 21 and the pressure roller 23 is released, which is sufficiently close to the drum 21. Therefore, the print sheet 30 can be sucked with strong suction force, and the print sheet 30 can be surely peeled off from the drum 21.

In the above-described embodiment, the feed-side suction port 83 and the discharge-side suction port 84 are formed in the same suction box 40, and the air on the outer sides of the respective sheet conveying surfaces 81*a* and 81*b* is sucked by the single suction fan 47 which reduces the pressure in the suction box 40. Accordingly, as shown in FIG. 21, the tip of the print sheet 30 passes above the discharge-side suction port 84 in a state where the feed-side suction port 83 is closed by the print sheet 30. Therefore, the print sheet 30 is sucked by the discharge-side suction port 84 with strong suction force. Hence, by the single suction fan 47, the print sheet 30 can be surely peeled off from the drum 21, as well as the print sheet 30 is sucked on the feed side.

In the above-described embodiment, the pressure roller 23 is assembled to the suction box 40, and thus the suction unit 24 is configured. Accordingly, when the suction unit 24 is detached from the body of the machine and attached thereonto, the suction box 40 and the pressure roller 23 can be detached therefrom and attached thereonto. Hence, the maintenance and exchange of the suction box 40 and the pressure roller 23 are easy. Moreover, the drum 21 is also assembled to the suction box 40, and accordingly, the maintenance and exchange of the drum 21 are also easy.

What is claimed is:

1. A stencil printing machine, comprising:

a rotationally driven drum, in which a stencil sheet is mounted on an outer peripheral surface;

a pressure roller which presses a print sheet fed to between the drum and the pressure roller and rotates together with the drum, in which the print sheet is fed from an upstream side of the pressure roller in a conveying direction to between the drum and the pressure roller, an image is transferred from the stencil sheet onto the fed print sheet in a process where the print sheet passes between the drum and the pressure roller, and the print sheet on which the image is transferred is discharged to a downstream side of the pressure roller in the conveying direction;

a suction port forming plate which is provided at a position close to a downstream peripheral surface of the pressure roller in the conveying direction and has a sheet conveying surface, in which a suction port is formed between the peripheral surface of the pressure roller and the suction port forming plate; and a suction fan which sucks air on an outer side of the sheet conveying surface from the suction port wherein the pressure roller is freely movable between a press position of pressing the drum and a standby position of being spaced from the drum, the suction port forming plate is provided to be freely movable together with the pressure roller and wherein effective width of the suction port is larger than the maximum width of the print sheet feedable.

2. The stencil printing machine according to claim 1, wherein the suction port is divided by a plurality of sheet suction preventing protrusions placed along a sheet conveying direction.

3. The stencil printing machine according to claim 1, wherein the suction port forming plate is formed as a part of a suction box which generates a suction wind from the suction port in a manner that pressure in the suction box is reduced by a drive of the suction fan, and the pressure roller is assembled to the suction box to construct a suction unit.

4. The stencil printing machine according to claim 3, wherein the drum is assembled to the suction box to be freely movable.

* * * * *